US011377858B2

(12) United States Patent
Ylikangas et al.

(10) Patent No.: US 11,377,858 B2
(45) Date of Patent: Jul. 5, 2022

(54) FLOORING SYSTEM PROVIDED WITH A CONNECTING SYSTEM AND AN ASSOCIATED CONNECTING DEVICE

(71) Applicant: Välinge Innovation AB, Viken (SE)

(72) Inventors: Roger Ylikangas, Lerberget (SE); Marcus Bergelin, Lerberget (SE); Anders Nilsson, Helsingborg (SE); Karl Quist, Höganäs (SE); Caroline Landgård, Lerberget (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 16/720,752

(22) Filed: Dec. 19, 2019

(65) Prior Publication Data

US 2020/0217084 A1 Jul. 9, 2020

(30) Foreign Application Priority Data

Jan. 8, 2019 (SE) ..... 1950015-6

(51) Int. Cl.
*E04F 15/02* (2006.01)

(52) U.S. Cl.
CPC .. *E04F 15/02044* (2013.01); *E04F 15/02005* (2013.01); *E04F 15/02038* (2013.01); *E04F 2015/02122* (2013.01)

(58) Field of Classification Search
CPC ..... E04F 2015/02094; E04F 15/02044; E04F 15/02038; E04F 13/0894;
(Continued)

(56) References Cited

U.S. PATENT DOCUMENTS 2,115,936 A 5/1938 Sterns
3,200,553 A 8/1965 Frashour et al.
(Continued)

FOREIGN PATENT DOCUMENTS

CA 2 792 923 A1 4/2013
CN 202695471 U 1/2013
(Continued)

OTHER PUBLICATIONS

Translation of Patent Document Cite No. 1-F26 on May 11, 2020 IDS JP 2008-031827A Feb. 14, 2008 Tamaoki et al.*
(Continued)

*Primary Examiner* — Babajide A Demuren
*Assistant Examiner* — Daniel J Kenny
(74) *Attorney, Agent, or Firm* — Buchanan Ingersoll & Rooney P.C.

(57) ABSTRACT

A decking system including floor elements and a connecting system including a connecting device for connecting a first and a second floor element, wherein the connecting device is removably connectable to a support member. A first and a second connecting portion of the connecting device are configured to cooperate with a first and a second engagement portion, respectively, of the first and second floor elements for vertically connecting the first and second floor elements. The connecting device further includes a displaceable portion which is horizontally displaceable and is configured to assume a first and a second horizontal state, wherein a horizontal extension of the connecting device in the second horizontal state is smaller than a horizontal extension of thereof in the first horizontal state.

15 Claims, 12 Drawing Sheets

(58) Field of Classification Search
CPC ..... E04F 2015/02072; E04F 15/02005; E04F 15/02122
See application file for complete search history.

(56) References Cited

U.S. PATENT DOCUMENTS

| | | | | |
|---|---|---|---|---|
| 3,535,844 | A | 10/1970 | Glaros | |
| 3,667,180 | A | 6/1972 | Tischuk | |
| 3,998,023 | A | 12/1976 | Anderson | |
| 3,998,024 | A | 12/1976 | Frandsen | |
| 4,122,641 | A | 10/1978 | Bard | |
| 4,123,885 | A | 11/1978 | Scott | |
| 4,170,859 | A | 10/1979 | Counihan | |
| 4,184,301 | A | 1/1980 | Anderson et al. | |
| 4,187,653 | A | 2/1980 | Kliewer, Jr. | |
| 4,316,351 | A | 2/1982 | Ting | |
| 4,765,107 | A | 8/1988 | Ting | |
| 5,274,979 | A | 1/1994 | Tsai | |
| 5,277,011 | A | 1/1994 | Serrano Martin | |
| 5,394,667 | A | 3/1995 | Nystrom | |
| 6,237,295 | B1 | 5/2001 | Ballard | |
| 6,260,326 | B1 | 7/2001 | Müller-Hartburg | |
| 6,324,796 | B1 | 12/2001 | Heath | |
| 6,470,641 | B1 | 10/2002 | Faure | |
| D485,160 | S | 1/2004 | Pelc | |
| 6,857,243 | B2 | 2/2005 | Bloomfield | |
| 6,865,856 | B2 | 3/2005 | Kim et al. | |
| 7,533,500 | B2 | 5/2009 | Morton et al. | |
| 7,866,111 | B2 * | 1/2011 | Johansson | E04F 15/02005 52/588.1 |
| 8,006,458 | B1 * | 8/2011 | Olofsson | E04F 15/02 52/582.1 |
| 8,291,666 | B1 | 10/2012 | Garrison | |
| 8,544,229 | B2 | 10/2013 | Kilgore et al. | |
| 8,728,609 | B2 | 5/2014 | Torres et al. | |
| 9,140,020 | B2 | 9/2015 | Torres-Pinzon | |
| 9,181,715 | B2 | 11/2015 | Orchard | |
| 9,376,822 | B2 | 6/2016 | Hannig | |
| 9,850,667 | B2 | 12/2017 | Engstrom | |
| 11,149,444 | B2 | 10/2021 | Bergelin et al. | |
| 2001/0027829 | A1 | 10/2001 | Crout | |
| 2002/0095897 | A1 | 7/2002 | Summerford | |
| 2006/0283126 | A1 | 12/2006 | Juan Puerta | |
| 2007/0066096 | A1 | 3/2007 | Gillis et al. | |
| 2007/0234670 | A1 | 10/2007 | Martel | |
| 2009/0217495 | A1 * | 9/2009 | Tipps | E04F 15/02 24/458 |
| 2010/0205895 | A1 | 8/2010 | Orchard | |
| 2011/0067335 | A1 | 3/2011 | Gibson et al. | |
| 2012/0110944 | A1 * | 5/2012 | Hess | E04F 15/02183 52/582.1 |
| 2013/0025228 | A1 | 1/2013 | Kilgore et al. | |
| 2013/0025230 | A1 | 1/2013 | Turner | |
| 2013/0104493 | A1 | 5/2013 | Orchard | |
| 2014/0165491 | A1 | 6/2014 | Lachevrotiere et al. | |
| 2014/0260041 | A1 | 9/2014 | Peck et al. | |
| 2014/0260043 | A1 | 9/2014 | Cottier | |
| 2015/0047278 | A1 | 2/2015 | Blount | |
| 2015/0176289 | A1 | 6/2015 | Hannig | |
| 2015/0368911 | A1 | 12/2015 | Kuijper | |
| 2016/0168865 | A1 * | 6/2016 | Pervan | B32B 5/14 52/309.1 |
| 2016/0168867 | A1 | 6/2016 | Chester | |
| 2016/0233820 | A1 | 8/2016 | Redel | |
| 2017/0037643 | A1 | 2/2017 | Mitchell | |
| 2017/0044776 | A1 | 2/2017 | Rodriguez Lopez | |
| 2017/0058534 | A1 | 3/2017 | Engström | |
| 2017/0314278 | A1 | 11/2017 | Lee et al. | |
| 2019/0309527 | A1 | 10/2019 | Bergelin et al. | |
| 2021/0214956 | A1 | 7/2021 | Bergelin | |

FOREIGN PATENT DOCUMENTS

| | | | |
|---|---|---|---|
| CN | 104775595 | A | 7/2015 |
| CN | 104831903 | A | 8/2015 |
| CN | 104947907 | A | 9/2015 |
| CN | 105281645 | A | 1/2016 |
| DE | 100 64 587 | A1 | 7/2002 |
| DE | 20 2007 002 282 | U1 | 6/2008 |
| DE | 20 2009 007 507 | U1 | 9/2009 |
| DE | 10 2008 051 441 | A1 | 3/2010 |
| DE | 20 2010 004 268 | U1 | 7/2010 |
| DE | 10 2009 031 825 | A1 | 1/2011 |
| DE | 20 2011 107 843 | U1 | 11/2011 |
| DE | 20 2011 106 654 | U1 | 4/2012 |
| DE | 10 2013 109 845 | | 3/2015 |
| DE | 10 2014 115 257 | A1 | 4/2016 |
| DE | 20 2016 001 234 | U1 | 6/2016 |
| EP | 1 106 842 | A1 | 6/2001 |
| EP | 1 567 731 | B1 | 3/2007 |
| EP | 2 096 232 | A1 | 9/2009 |
| EP | 2 711 481 | A1 | 3/2014 |
| EP | 2 816 172 | A2 | 12/2014 |
| EP | 2 899 330 | A1 | 7/2015 |
| EP | 3 090 850 | A1 | 11/2016 |
| EP | 3 112 551 | A1 | 1/2017 |
| EP | 3 112 554 | A1 | 1/2017 |
| FR | 2 843 414 | | 2/2004 |
| FR | 2 914 670 | A1 | 10/2008 |
| FR | 3032739 | A1 | 8/2016 |
| JP | 2008-031827 | A | 2/2008 |
| JP | 2010-242365 | A | 10/2010 |
| JP | 2011-069155 | A | 4/2011 |
| JP | 5313012 | B2 | 10/2013 |
| JP | 2014-214498 | A | 11/2014 |
| KR | 2009-0117287 | A | 11/2009 |
| KR | 10-0944453 | B1 | 3/2010 |
| KR | 10-1042682 | B1 | 6/2011 |
| KR | 2012-0032096 | A | 4/2012 |
| KR | 2013-0056702 | A | 5/2013 |
| KR | 2016-0025167 | A | 3/2016 |
| WO | WO 2014/179838 | A1 | 11/2014 |
| WO | WO 2015/159136 | A1 | 10/2015 |
| WO | WO 2015/174835 | A1 | 11/2015 |
| WO | WO 2018/169483 | A1 | 9/2018 |

OTHER PUBLICATIONS

U.S. Appl. No. 16/492,257, Bergelin.
International Search Report and Written Opinion issued in PCT/SE2019/051314, dated Feb. 13, 2020, Patent-och registreringsverket, Stockholm, SE, 16 pages.
Official Action and Search Report issued in SE Application No. 1950015-6, dated Aug. 22, 2019, Swedish Patent and Registration Office, 8 pages.
Bergelin, Marcus, U.S. Appl. No. 16/492,257 entitled "Connecting Device, Support Element and Connecting System for Boards," filed in the U.S. Patent and Trademark Office, filed Sep. 9, 2019.
Bergelin, Marcus, et al., U.S. Appl. No. 17/407,674 entitled "Set of Decking Boards Provided with a Connecting System," filed in the U.S. Patent and Trademark Office, on Aug. 20, 2021.

* cited by examiner

FLOORING SYSTEM PROVIDED WITH A CONNECTING SYSTEM AND AN ASSOCIATED CONNECTING DEVICE

CROSS REFERENCE TO RELATED APPLICATIONS

The present application claims the benefit of Swedish Application No. 1950015-6, filed on Jan. 8, 2019. The entire contents of Swedish Application No. 1950015-6 are hereby incorporated herein by reference in their entirety.

TECHNICAL FIELD

The disclosure generally relates to a flooring system, such as a decking system, comprising floor elements and a connecting system for connecting the floor elements. More specifically, the flooring system comprises a connecting device for mechanical connection of the floor elements. The disclosure also relates to the connecting device itself.

BACKGROUND

Separate clips or rails for locking floor panels, such as decking panels, to a support structure, e.g. joists, are known. Typically, a situation arises in which an arbitrary floor panel in a set of installed floor panels needs to be removed, such as when the panel is damaged or when access to an area under the installed panels is desired. The known clips or rails, however, are configured such that it is cumbersome to remove an arbitrary floor panel in the set of installed floor panels. Moreover, it is typically equally cumbersome to reinstall the panel or install a new panel replacing the removed panel.

For instance, according to some solutions, such as that disclosed in EP 1 567 731 B1, a floor strip mounting component used for connecting floor boards needs to be irreparably broken in order to remove an installed floor board.

Furthermore, EP 3 112 551 A1 discloses a mounting part for fastening visible profiles in a terrace system. The mounting part comprises retaining bars that are configured to engage with a respective recess in a pair of adjacent visible profiles. A rigid structural section is formed on the mounting part for a fixed mounting of a first visible profile, and an elastic structural section is formed on the mounting part for a movable mounting of a second visible profile. However, the elastic structural section is elastic only to a small degree for admitting a pre-tensioning of a retaining bar of the mounting part. Thereby, an arbitrary visible profile in a set of fastened visible profiles cannot be removed without removing a sequence of visible profiles.

SUMMARY

It is therefore an object of at least exemplary embodiments of the present inventive concept to provide a flooring system, such as a decking system, comprising floor elements and a connecting system comprising a connecting device in which an arbitrary floor element may be removed, in particular without damaging any component of the flooring system, such as a floor element or the connecting device.

It is also an object of at least exemplary embodiments of the present inventive concept to provide such a flooring system while providing a reliable connecting strength between the floor elements.

Additionally, it is an object of at least exemplary embodiments of the present inventive concept to provide such a flooring system whereby a transverse distance between the floor elements may be controlled in an improved manner.

It is also an object of at least exemplary embodiments of the present inventive concept to provide a corresponding connecting device for a flooring system in accordance with any of the objects above.

At least some of these and other objects and advantages that will be apparent from the description have been achieved by the various aspects described below.

In accordance with a first exemplary aspect of the inventive concept, there is provided a flooring system, such as a decking system, comprising floor elements and a connecting system comprising a connecting device for connecting a first floor element and a second floor element. The connecting device comprises a first and a second connecting portion. An edge portion of the first and second floor elements comprises a first and a second engagement portion, respectively. The first and the second connecting portions are configured to cooperate—for example, engage—with the first and the second engagement portions, respectively, for vertically connecting the first and second floor elements. The connecting device further comprises a displaceable portion which is horizontally displaceable, preferably along a width direction of the connecting device.

Due to a reduced horizontal extension of the connecting device, the first and second floor elements may be at least partly, and for example completely, disconnected from each other when the displaceable portion is displaced. In particular, one or both of the first and second floor elements may be removed from the flooring system, such as by angling and/or a vertical displacement of the respective floor element. At least in some embodiments, the disconnection may be achieved without using any tools.

Each floor element may be a decking element, such as a decking panel. The floor element, such as the decking element, may comprise wood, such as softwood or hardwood, timber, lumber, treated lumber, pressure treated lumber, composite lumber, composite material, such as wood-plastic composite (WPC), or aluminium. Exemplary embodiments of the present disclosure can be particularly advantageous for, but not limited to, floor elements that are fairly dimensionally stable, e.g. under variations of an ambient temperature and/or humidity.

Each floor element may extend in a transverse direction and in a longitudinal direction, both being horizontal directions extending in a horizontal plane. The longitudinal extension preferably is larger than the transverse extension. The horizontal plane may extend in the transverse direction and in the longitudinal direction. The horizontal plane may be parallel with a top side and/or an underside of each floor element. The top side may be a visible side of the floor element. Each floor element may also extend in a vertical direction which is perpendicular to the horizontal plane. By upwards and downwards is meant a direction away from a top side of the floor element and away from an underside of the floor element, respectively.

Preferably, the floor elements are essentially identical.

The connecting device may have an extension in a width direction and in a depth direction. Moreover, the connecting device may extend in a vertical direction which is perpendicular to the width and depth directions. The depth direction and the width direction of the connecting device may be parallel with the longitudinal direction and the transverse direction of the first and second floor elements, respectively, when the first and second floor elements are connected. The vertical direction of the connecting device may be parallel to the vertical direction of the floor elements when the first and second floor elements are connected.

The first and second connecting portions may be disposed on the connecting device at different positions along its width direction, preferably at opposite sides of the connecting device. Each connecting portion may extend along the depth direction.

In the first horizontal state, the first connecting portion and/or the second connecting portion may extend essentially in parallel with a top side and/or an underside of the floor elements. Moreover, the first connecting portion and/or the second connecting portion may include a respective surface that is essentially parallel to the top side and/or the underside of the floor elements. The respective surface may be a first and a second bottom surface of a first and a second protrusion on which the first and second connecting portions may be provided. Alternatively, or additionally, the first engagement portion and/or the second engagement portion may extend essentially in parallel with the top side and/or the underside of the floor elements. Optionally, the first and second engagement portions may be provided in the form of a first and a second lower wall of a first groove and a second groove, respectively, of the first and second floor elements. Thereby, a displacement of a connecting portion against a respective engagement portion, such as during a displacement of the displaceable portion, may be facilitated.

Each floor element may comprise a first and a second engagement portion which may be arranged at different positions along its transverse direction. Preferably, the first and second engagement portions are arranged at opposite sides of the floor element. Each engagement portion may extend along the longitudinal direction for cooperating with a respective connecting portion.

Furthermore, the edge portion of the first floor element and the edge portion of the second floor element may face each other when the first and second floor elements are connected.

The displaceable portion may be horizontally displaceable with respect to a body portion of the connecting device.

Generally, a first and/or a second side portion of the connecting device may comprise the displaceable portion.

A first and/or a second side portion of the connecting device may form the displaceable portion, for varying, preferably decreasing, a relative distance between the first and second side portions. The first and/or second side portion may be displaceable towards and away from the second and/or first side portion, respectively.

The displaceable portion may be horizontally displaceable by virtue of being flexible or elastic. The displaceable portion may be more flexible than the body portion.

The displaceable portion may be compressible.

The body portion may comprise a portion that is horizontally fixed, in particular immobile, when the displaceable portion is horizontally displaced.

A portion of the body portion may be configured to be fixed with respect to a support member when the connecting device is connected, preferably removably connected, thereto. The body portion may comprise a bottom portion and, optionally, a first and/or a second side portion of the connecting device. The body portion may be fixed transversely and/or longitudinally to the support member.

The connecting device may be configured to assume a first and a second horizontal state, a horizontal extension of the connecting device in the second horizontal state being smaller than a horizontal extension of the connecting device in the first horizontal state.

A horizontal extension of the connecting device in each of the first and second horizontal states may be an extension or a length along the width direction.

The connecting device may be compressible at least along a horizontal direction, such as the width direction. For example, the connecting device may be compressible along the horizontal direction only. The connecting device may be configured to transition from the first horizontal state to the second horizontal state by horizontally compressing the connecting device by displacing the displaceable portion. The connecting device may be configured to be horizontally compressed by horizontally displacing the first and second floor elements relatively towards each other.

The connecting device may be configured to return partly or, preferably completely, from the second horizontal state to the first horizontal state. In particular, the connecting device may be configured to return partly or, preferably completely, to an initial, uncompressed state of the connecting device when the connecting device is no longer compressed. Thereby, the connecting device, in particular the displaceable portion, may remain intact, without being damaged. For example, it may be re-used.

The first and second connecting portions may be provided at the same, or substantially the same, height along the vertical direction in the first horizontal state. In some embodiments, however, they are provided at different heights. This may guide a user to install the connecting device correctly. In a first example, the first connecting portion is provided above the second connecting portion. In a second example, the first connecting portion is provided below the second connecting portion.

The first and second connecting portions may join and/or extend outwards from a first and a second side portion of the connecting device, respectively.

The first and second connecting portions may be horizontally fixed, in particular immobile, with respect to each other when the displaceable portion is horizontally displaced.

The body portion may comprise the first and/or the second connecting portion. In non-restrictive examples, the displaceable portion may be provided below the first and/or the second connecting portion.

The first and second connecting portions may be displaced horizontally with respect to each other when the displaceable portion is horizontally displaced.

The displaceable portion may comprise the first and/or the second connecting portion.

The horizontal extension of the connecting device in each of the first and second horizontal states may be: a maximal horizontal extension of the connecting device, such as at a top portion thereof, or a horizontal extension, such as a maximal horizontal extension, between a first abutment portion and a second abutment portion configured to abut the first and second floor elements, respectively, in the first horizontal state, the first and second abutment portions extending at least in a vertical direction, or a horizontal extension between the displaceable portion, such as an outermost surface thereof along a width direction, and a fixed surface of the connecting device, such as a first or a second protrusion, such as an outermost surface thereof along a width direction.

A ratio R between the horizontal extension of the connecting device in the second horizontal state and the horizontal extension of the connecting device in the first horizontal state may be less than or equal to 0.95, preferably less than or equal to 0.9, and more preferably less than or equal to 0.85. In non-limiting examples, the ratio R may be less than or equal to 0.80, or even less than or equal to 0.70.

The first and second floor elements may be vertically connected in the first horizontal state, and in the second horizontal state a strength of a vertical connection of a pair of floor elements in the flooring system may be reduced compared to a strength of the vertical connection of said pair of floor elements in the first horizontal state. For example, said pair of floor elements may be vertically disconnected in the second horizontal state. Additionally or alternatively, at least one floor element in the pair of floor elements may be removable in the second horizontal state, such as by angling and/or by a vertical displacement of the respective floor element.

The vertical connection of a pair of floor elements, for example comprising the first and second floor elements, may comprise a vertical connection between a floor element in said pair, such as the first floor element, and the connecting device. Alternatively, or additionally, the vertical connection of the pair of floor elements may comprise a vertical connection between the other floor element in said pair, such as the second floor element, and the connecting device. The connecting device may in turn be connected to a support member as described elsewhere in this disclosure.

A vertical disconnection of a pair of floor elements, for example comprising the first and second floor elements, may comprise a vertical disconnection between at least one floor element in said pair, such as the first floor element and/or the second floor element, and the connecting device.

In a first example, the vertical connection of a pair of floor elements may be reduced by providing the connecting device in the second horizontal state per se. In a second example, at least one floor element may, in addition, be displaced for reducing the vertical connection of a pair of floor elements.

The pair of floor elements may comprise the first floor element and a floor element adjacent to the first floor element, such as the second floor element which is adjacent to the edge portion of the first floor element or a floor element adjacent to an opposite edge portion of the first floor element.

The pair of floor elements may comprise the second floor element and a floor element adjacent to the second floor element, such as the first floor element which is adjacent to the edge portion of the second floor element or a floor element adjacent to an opposite edge portion of the second floor element.

In some embodiments, a strength of the vertical connection of two pairs of floor elements in the flooring system may be reduced in the second horizontal state compared to a strength of the vertical connection of said two pairs of floor elements in the first horizontal state. For example, said two pairs of floor elements may be vertically disconnected in the second horizontal state. Additionally or alternatively, at least one floor element in the two pairs of floor elements may be removable in the second horizontal state, such as by angling and/or by a vertical displacement of the respective floor element. As indicated above, at least one floor element might have to be displaced for achieving the reduction of the vertical connection.

In a first example, a first pair may consist of the first and second floor elements and a second pair may consist of the first floor element and a floor element adjacent to an opposite edge portion of the first floor element. Optionally, a strength of the vertical connection of a third pair of floor elements may be reduced in the second horizontal state compared to a strength of the vertical connection of said third pair in the first horizontal state. For example, said third pair of floor elements may be vertically disconnected in the second horizontal state. Additionally or alternatively, at least one floor element in the third pair of floor elements may be removable in the second horizontal state, such as by angling and/or by a vertical displacement of the respective floor element. For example, the third pair of floor elements may consist of the second floor element and a floor element adjacent to an opposite edge portion of the second floor element.

In a second example, a first pair may consist of the first and second floor elements and a second pair may consist of the second floor element and a floor element adjacent to an opposite edge portion of the second floor element.

In a non-limiting embodiment, the strength of the vertical connection of the first and second floor elements may be provided by a cooperation, such as a contact area, between the second engagement portion and the second connecting portion. Thus, the contact area may be smaller in the second horizontal state than in the first horizontal state. Alternatively, or additionally, the strength of the vertical connection may be provided by a cooperation, such as a contact area, between the first engagement portion and the first connecting portion. The contact area may be smaller in the second horizontal state than in the first horizontal state. In particular, the floor elements may be vertically disconnected when the second engagement portion and the second connecting portion disengage, or for example completely disengage, with each other. Alternatively, or additionally, the floor elements may be vertically disconnected when the first engagement portion and the first connecting portion disengage, or for example completely disengage, with each other.

Each of said contact areas may be reduced by a relative displacement of the respective engagement portion and connecting portion and/or by the connecting portion in the second horizontal state being angled with respect to the engagement portion as compared to the first horizontal state.

In non-restrictive examples, a ratio of the respective strengths $T_{S2}$, $T_{S1}$ of the vertical connection in the second horizontal state and the first horizontal state may be $0 \leq T_{S2}/T_{S1} \leq 0.8$, preferably $0 \leq T_{S2}/T_{S1} \leq 0.5$, or more preferably $0 \leq T_{S2}/T_{S1} \leq 0.2$. For example, $T_S$, and hence $T_{S2}$, $T_{S1}$, may represent a contact area, e.g., as described above. Indeed, the contact area may be a contact area between first engagement portion and the first connecting portion and/or a contact area between second engagement portion and the second connecting portion.

In the second horizontal state, a lower part of one floor element, such as a first lip, may be horizontally spaced from the connecting device. Thereby, the floor element may be removed without contacting the connecting device.

The first and second floor elements may also be horizontally connected in at least a first direction, such as in the transverse direction. For example, the edge portion of the second floor element, such as the first lip, may engage with the second side portion, such as the second abutment portion, and/or the edge portion of the first floor element, such as the second lip, may engage with the first side portion, such as the first abutment portion. By these engagements, a displacement of the first and/or second floor elements towards each other may be counteracted or even made impossible. Typically, however, a small displacement may be conceivable, due to an intrinsic flexibility of the connecting device.

Moreover, a displacement of the first and second floor elements away from each other may be counteracted or even made impossible. A similar engagement as described for the first and second floor elements may be conceivable between an opposite edge portion of the first floor element and a connecting device connecting the first floor element and a floor element adjacent to the first floor element. Alternatively, or additionally, there may be a similar engagement between an opposite edge portion of the second floor element and a connecting device connecting the second floor element and a floor element adjacent to the second floor element.

The first and/or second floor elements may also be horizontally connected to the connecting device per se, such as along the longitudinal direction, by friction connections. This may be implemented by the cooperation between the first and the second connecting portions and the first and the second engagement portions, respectively.

The cooperation between the first and the second connecting portions and the first and the second engagement portions, respectively, may be pretensioned. For example, a vertical distance from a bottom portion of the connecting device to the first and/or the second connecting portion may be smaller than a vertical distance from an underside of the respective floor element to the first and/or the second engagement portion.

The connecting device may further comprise a locking device for locking the connecting device in the second horizontal state. Thereby, the connecting device may remain in a compressed state, such as the second horizontal state, even after a compression force is no longer applied. This may simplify a removal of a floor element.

At least a part of the locking device may be provided on the displaceable portion.

The locking device may comprise a first and a second locking element configured to cooperate with each other, such as by a snapping engagement. The first and the second locking elements may be provided on a first and a second arm portion of the connecting device, respectively. Preferably, the first and second arm portions extend horizontally towards each other.

The first and the second locking elements may each comprise a sliding surface, each preferably being at least partly planar, configured to slide against each other when the connecting device transitions from the first to the second horizontal state.

The first and the second locking elements may be provided as hook elements.

The connecting device may comprise a contact portion configured to contact the displaceable portion.

The first arm portion and the second arm portion may be connected to each other by a breaking portion. More generally, the displaceable portion may be connected to the contact portion of the connecting device by a breaking portion. For example, the first and second locking elements may be connected to each other by a breaking portion. The breaking portion may be configured to be broken during removal of a floor element, such as when the first and second floor elements are displaced towards each other.

The displaceable portion and the contact portion may be provided with a resistance element. For example, the first and the second locking elements may be provided with a resistance element.

The locking device may be configured to be unlocked from the second horizontal state by compressing, preferably horizontally compressing, the connecting device and/or by displacing a first arm portion of the connecting device away from a second arm portion of the connecting device, such as by a vertical displacement and/or an angling thereof. For example, the displaceable portion may be displaced.

The connecting device may comprise a guiding surface, optionally joining a second locking element of the locking device of the connecting device for locking the connecting device in the second horizontal state.

The displaceable portion may comprise an arm portion, such as a first arm portion. The arm portion may be configured to vary, preferably decrease, a relative distance between the arm portion and the first and/or the second side portion.

The arm portion may be a first arm portion and the connecting device may further comprise a second arm portion, the first and the second arm portions preferably extending horizontally towards each other.

The arm portion may be provided in a first or a second side portion, preferably comprising a first portion extending at least partially in a direction away from a wall portion of the first or second side portion and optionally further comprising a second portion extending at least partially in a direction towards the wall portion.

The arm portion may comprise at least two arms, preferably extending at least partially towards a first side portion and preferably being provided symmetrically around a centre line extending along a width direction.

The connecting device may comprise a barrier member configured to prevent the displaceable portion, such as an arm portion, from being displaced beyond an obstruction element. The obstruction element may be a contact portion of the connecting device. For example, the obstruction element may be at least a portion of a wall portion of the connecting device.

The barrier member may comprise a first barrier element and a second barrier element configured to cooperate with the first barrier element, wherein the first barrier element preferably is provided in the displaceable portion and the second barrier element preferably is provided in a first side portion of the connecting device, such as in a wall portion thereof.

The second barrier element may comprise a pocket configured to receive at least a portion of the first barrier element.

The displaceable portion may be configured to be displaced beyond the obstruction element when a compression force exceeding a threshold value is applied.

The first and second connecting portions may be provided on a first and a second protrusion of the connecting device, respectively. The first and second protrusions may extend along the width direction of the connecting device. Each of the first and second protrusions may extend in a direction away from a centre portion of the connecting device.

The connecting device may comprise a top portion comprising the first and second protrusions.

The connecting device may comprise a first abutment portion and/or a second abutment portion configured to abut the first and/or second floor elements in the first horizontal state, the first and second abutment portions extending at least in a vertical direction. The first and the second abutment portion may be provided in a first and a second side portion of the connecting device, respectively.

In the first horizontal state, the first abutment portion may engage with a first lip of the first floor element, and/or the second abutment portion may engage with a first lip of the second floor element. The first and/or the second abutment portion may be configured to be spaced from the first and/or second floor elements in the second horizontal state, such as spaced from the first lip of the first and/or second floor elements.

The first and/or the second abutment portion may comprise at least one curved abutment surface.

The first or the second abutment portion may be provided on an arm portion, such as a first arm portion.

The connecting device may be flexible, preferably along the width direction. Thereby, the floor elements may be displaced towards each other. A first section of the connecting device may be more flexible, preferably horizontally flexible, than a second section of the connecting device, wherein the first section preferably is provided adjacent to the second floor element and the second section preferably is provided adjacent to the first floor element when the first and second floor elements are connected. The horizontal flexibility may be provided along the width direction of the connecting device.

The first section may comprise the displaceable portion. Moreover, the second section may comprise the body portion.

A connecting device, such as a flexible connecting device, may be compressed and may return partly or, preferably completely, to an initial, uncompressed state of the connecting device when the connecting device is no longer compressed.

It is understood that in some embodiments the second section may be more flexible than the first section.

The first and second engagement portions may be provided in a first groove and a second groove, respectively, of the first and second floor elements.

The edge portion of each of the first and second floor elements may comprise a first and a second lip provided below and above the first and the second groove of the first and second floor elements, respectively.

The second lip of the first floor element may extend horizontally beyond the first lip of the first floor element, and/or the second lip of the second floor element may extend horizontally beyond the first lip of the second floor element.

The second lip of the second floor element may comprise a prominence extending beyond an uppermost portion of the edge portion of the second floor element.

The second lip of the first floor element and the prominence may at least partially overlap each other in a horizontal plane being parallel with a top side and/or an underside of each floor element.

In exemplary embodiments, the features of the edge portion, such as their lip configurations, of each of the first and second floor elements described above may be interchanged.

A cross-sectional profile of each floor element may be the same along the longitudinal direction of the floor element. Thereby, a cross-sectional profile of at least one selected from the group of the first groove, the second groove, the first protrusion, and the second protrusion, may be the same along the longitudinal direction.

The first and second floor elements may be configured to conceal the connecting device when the floor elements are connected, preferably such that edge portions of the first and second floor elements at least partially overlap each other in a horizontal plane being parallel with a top side and/or an underside of each floor element.

The connecting device may be visible when the first and second floor elements are connected. Outermost adjacent portions of the first and second floor elements may be spaced from each other.

The connecting device may comprise a protruding element configured to be provided in the first groove, the first groove optionally comprising a recess for accommodating at least a portion of the protruding element. The connecting device may thereby be transversely connected to the first floor element. The protruding element may at least extend vertically upwards. Moreover, the recess may be open downwards in the first groove. The protruding element may be configured to be provided in the first groove in the first and/or the second horizontal state. By virtue of the protruding element, the connecting device may be positioned horizontally with respect to the first floor element. Moreover, the connecting device may be held in position, especially during installation of the floor elements.

The connecting device may comprise a friction element, preferably provided in a cavity of the connecting device, and being configured to engage with a floor element, such as the first floor element, in the first horizontal state. For example, the friction element may engage with the first lip of the first floor element, such as with a first lip surface of the first lip. Thereby, the connecting device may maintain an engagement with the first floor element, even under dimensional variations of the floor elements, caused e.g. by temperature or humidity fluctuations.

The connecting device may be configured to transition from the first horizontal state to the second horizontal state when a compression force of the connecting device exceeds a predetermined threshold value $F_{TH}$. Thereby, a transverse distance between the floor elements may be controlled in an improved manner, since a force exceeding a threshold force may be required to displace the floor elements towards each other beyond a certain point. For example, the threshold value may be larger than typical forces caused by strong winds acting on the flooring system. The threshold value may be adapted to a fixed number of connecting devices connecting the first and second floor elements. In particular, a larger number of connecting devices arranged along the longitudinal extension of the floor elements may give rise to an increased resistance and hence may give rise to a smaller threshold value of an individual connecting device. In a non-limiting example, $F_{TH}$ for compressing the first and second floor elements connected by at least one connecting device may be 20-500 N, such as for polymer-based connecting devices. In another non-limiting example, $F_{TH}$ for compressing the first and second floor elements connected by at least one connecting device may be 100-500 N/m, such as for polymer-based connecting devices.

The connecting device may be provided with a non-linear spring constant along a horizontal direction, the horizontal direction preferably being parallel with a width direction of the connecting device. The non-linear spring constant may be dependent on a degree of compression of the connecting device along the width direction.

A non-linear behavior of the connecting device may be activated by a pair of engaging elements of the connecting device configured to engage with each other during compression of the connecting device. For example, the engaging elements may be a respective sliding surface of the first and second locking elements or a first and a second barrier element of the connecting device.

A spring constant of the connecting device along a horizontal direction, such as the width direction, may be configured to decrease when compressing the connecting device from a first compression level to a second compression level. Thereby, a risk of an accidental disconnection of the connecting device may be reduced, while facilitating disconnection once such disconnection has been commenced. In a first example, the spring constant may have a linear behavior at both the first and the second compression levels. In a second example, the spring constant may have a non-linear behavior at the first compression level and a linear behavior at the second compression level.

The connecting device may be provided with at least a first and a second, optionally also a third, horizontal spring constant. Each horizontal spring constant may be consecutively activated. In non-limiting examples, any of said first, second, or third horizontal spring constants may be a substantially linear or a non-linear horizontal spring constant.

The connecting device may have a first horizontal spring constant in or close to the first horizontal state when the displaceable portion does not engage with the first and/or the second side portion, a second horizontal spring constant when transitioning from the first to the second horizontal state by being compressed, such as when the displaceable portion engages with the first and/or the second side portion, and a third horizontal spring constant when the second horizontal state has been reached or passed.

The connecting device may be connectable, preferably removably connectable, to a support member, such as by a fastening element provided through a hole in the connecting device. The fastening element may be a screw, a nail, or similarly.

Alternatively, or additionally, the connecting device may comprise a coupling portion configured to cooperate with a mounting portion of a support member, preferably by a snapping engagement.

The connecting device may be transversely connectable and preferably also longitudinally connectable to the support member.

The support member may be a joist. Moreover, the support member may be made of wood or aluminium or may be a polymer-based support member.

The flooring system may comprise a first set of connecting devices that are connected to the support member, such as transversely and longitudinally connected thereto, and a second set of connecting devices that are not longitudinally connected to the support member, but may optionally be transversally connected thereto. For example, at least one connecting device of the second set may be provided between a pair of connecting devices according to the first set. A connecting device of the second set may be longitudinally slidable along the support member.

The connecting device may be integrally formed, i.e. formed in one piece. For example, the displaceable portion may be integrally formed with the connecting device, such as with the body portion. The connecting device may comprise a single material, such as a metal, preferably steel or aluminium, or a polymer-based material.

In some embodiments, the displaceable portion is separately formed from the connecting device, such as from the body portion. The displaceable portion may be attached to the first or the second side portion, such as a wall portion thereof, e.g. by an attaching element. For example, the attaching element may be a snapping element or may comprise a tongue and tongue slot configuration. The connecting device may comprise a first material, such as a metal, such as steel, or a polymer-based material, and a second material, such as a polymer-based material. The separately formed displaceable portion may comprise the first material and the body portion may comprise the second material. The body portion may be a remainder of the connecting device to which the displaceable portion may be attached.

In the embodiments of the integrally formed as well as the separately formed connecting devices above the polymer-based material may be polyamide (PA), such as type 6 or 66, polypropylene (PP), polyethylene (PE), polyvinyl chloride (PVC), polystyrene (PS), polyurethane (PU), polycarbonate (PC), acrylonitrile butadiene styrene (ABS), or thermoplastic elastomer (TPE).

At least the body portion of the connecting device, or optionally the entire connecting device, may be extruded, injection moulded, 3D-printed, 3D-printed in powder, etc. Moreover, at least the body portion may comprise a reinforcement material, such as a glass-fibre material.

According to a second exemplary aspect of the inventive concept, there is provided a connecting device for connecting a first floor element and a second floor element. The connecting device comprises a first and a second connecting portion which are configured to cooperate—for example, engage—with a first and a second engagement portion of the first and second floor elements, respectively, for vertically connecting the first and second floor elements. The connecting device further comprises a displaceable portion which is horizontally displaceable with respect to a body portion of the connecting device, preferably along a width direction of the connecting device.

Embodiments and examples of the connecting device in accordance with the second aspect are largely analogous to those of the first aspect, wherein reference is made to the above. In particular, embodiments and examples of at least one selected from the group of the displaceable portion, the body portion, the contact portion, the first and second connecting portions, the first and a second protrusions, the first and second side portions, the first and second abutment portions, the first and second sections, first and/or the second arm portions, the barrier member, first and second barrier element, the pocket, the obstruction element, the locking device, the first and second locking elements, the hole, the coupling portion, the mounting portion, the protruding element, the friction element, the resistance element, the breaking portion, the separate or integral forming, the spring constant, such as the non-linear spring constant, the material, and the configurations of the first and second horizontal states, and their transitions, of the connecting device may be the same.

Further exemplary aspects of the inventive concept and embodiments and examples of each of the first and second aspects are provided in an "Exemplary Embodiments" section below. It is emphasized that the embodiments and examples of any aspect may be combined with embodiments and examples of any other aspect.

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Next, embodiments of flooring systems and connecting devices will be described with reference to FIGS. 1*a-c*, 2*a-e*, 3*a-f*, 4*a-h*, 5*a-e*, 6*a-b*, 7*a-d*, 8*a-f*, 9*a-f*, 10*a-f*, 11*a-f* and 12*a-b*. Preferably, the flooring system is a decking system, but other flooring systems—preferably for outdoor applications—are equally conceivable, such as flooring systems for verandas, terraces or the like.

Figure 1A:
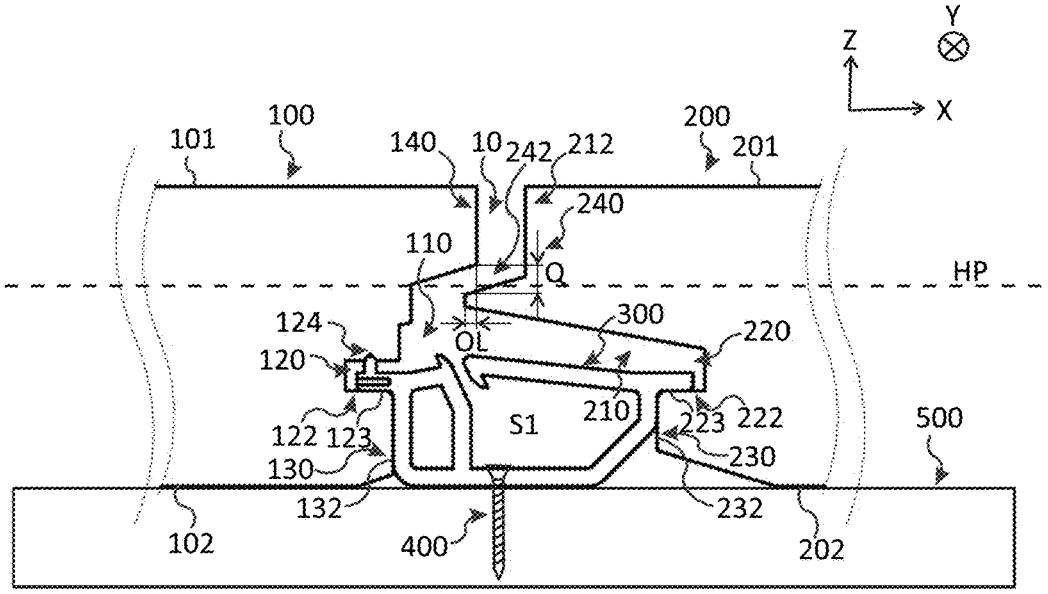
FIGS. 1*a-c* illustrate embodiments of floor elements connected by a connecting device in side views.
Figure 1B:
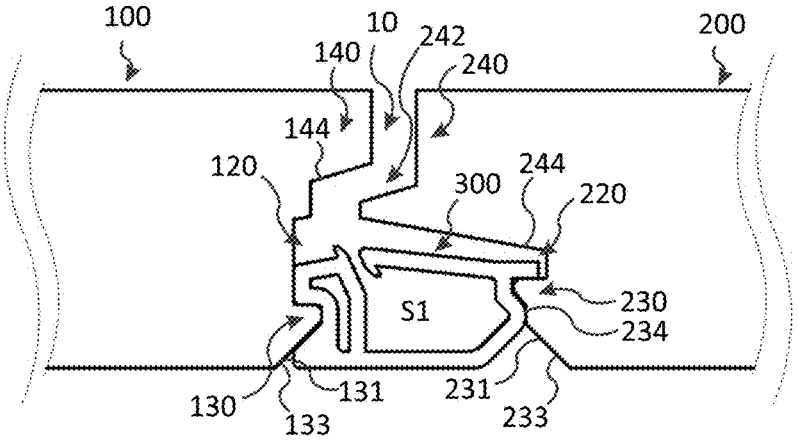
Figure 1C:
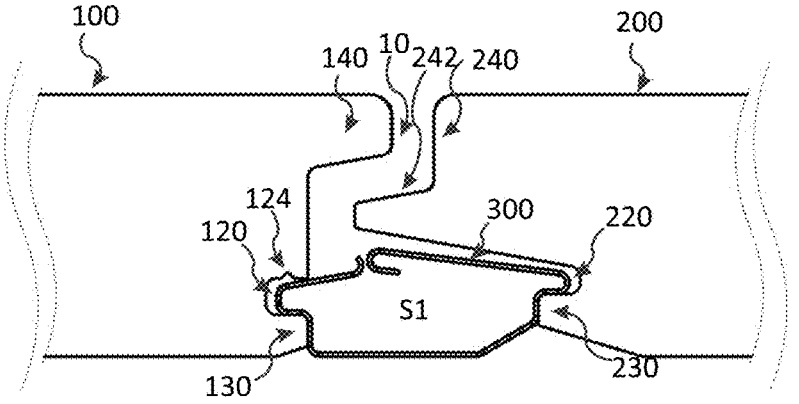

FIGS. 1*a-c* are side views of embodiments of a flooring system comprising a set of, preferably essentially identical, floor elements comprising a first 100 and a second 200 floor element. The flooring system further comprises a connecting system comprising a connecting device 300 for connecting the floor elements 100, 200. The floor elements may be decking elements, such as decking panels.

The first 100 and second 200 floor elements each comprise an edge portion 110, 210, a top side 101, 201, and an underside 102, 202. As illustrated in the embodiment in FIG. 2*e*, each of the first and second floor elements also comprises an opposite edge portion 114, 214 which preferably is essentially identical to the edge portion 210, 110 of the second and the first floor elements, respectively.

The edge portion 110 of the first floor element comprises a first groove 120. A first lip 130 and a second lip 140 are provided below and above the first groove, respectively. The second lip 140 extends horizontally beyond the first lip 130.

The edge portion 210 of the second floor element comprises a second groove 220. A first lip 230 and a second lip 240 are provided below and above the second groove, respectively. The second lip 240 extends horizontally beyond the first lip 230.

Optionally, a lower wall 133, 233 of the first lip 130 and/or the first lip 230 may comprise an inclined surface 131, 231. Moreover, an underside 144, 244 of any of the second lips 140, 240 may be inclined with respect to the respective top side 101, 201.

The first and second grooves 120 and 220 comprise a first 122 and a second 222 engagement portion, respectively. In the present embodiment, the first and second engagement portions are provided in the form of a first 123 and a second 223 lower wall of the respective first groove. Each lower wall 123, 223 may comprise at least a partially planar portion which, preferably, is essentially parallel with the top side 101, 201 and/or the underside 102, 202. More generally, the first 122 and/or the second 222 engagement portion may extend essentially in parallel with the top side 101, 201 and/or the underside 102, 202 of the floor elements. The lower walls 123 and 223 may be an upper wall of the first lips 130 and 230, respectively.

According to a preferred embodiment, there is a space 10 between upper parts of the edge portions 110, 210. In the embodiment shown in FIG. 1*a*, the second lip 240 comprises a prominence 242 extending beyond an uppermost portion 212 of the edge portion 210. The second lip 140 of the first floor element and the prominence 242 may at least partially overlap each other in a horizontal plane HP which is parallel with the top side 101, 201 and/or the underside 102, 202. The horizontal plane HP extends in a transverse direction X and in a longitudinal direction Y of the floor elements. Thereby, the connecting device may be concealed from above when the floor elements are connected. In one example, and as illustrated in FIG. 1*a* and in a top view of the floor elements in FIG. 2*a*, the overlap may be an overlap OL between a projection of each the second lip 140 and the prominence 242 onto the horizontal plane HP. The second lip 140 and the prominence 242 may be vertically spaced by a separation Q where they overlap. In some embodiments, and as shown e.g. in FIG. 1*c*, the separation Q, such as a minimal separation in the overlap OL, is larger than or equal to the space 10, such as a minimal space, between the upper parts. Thereby, debris, dirt or the like having a maximal extension that is smaller than or equal to the space 10 may fall down between floor elements 100, 200 more easily.

Preferably, the grooves 120, 220 and the lips 130, 140, 230, 240 extend along the entire longitudinal direction Y of the first and second floor elements, respectively.

Figure 3A:
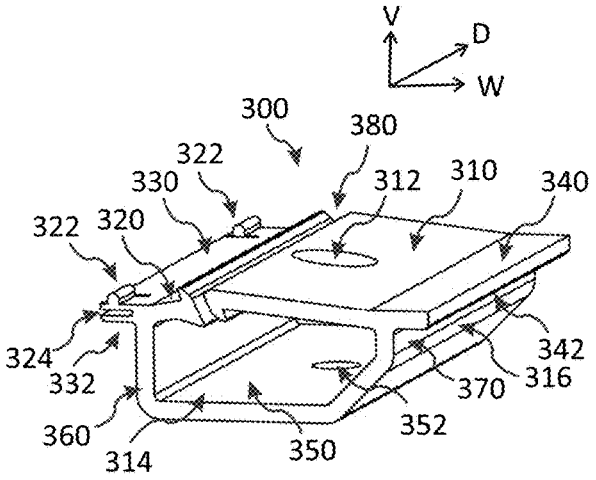
FIGS. 3*a-f* illustrate embodiments of connecting devices in perspective views and side views.
Figure 3B:
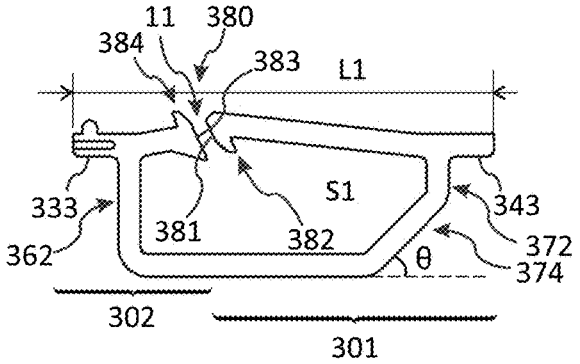

FIGS. 3*a* and 3*b* illustrate an embodiment of the connecting device 300 in a perspective view and a side view, respectively. The connecting device extends in a width direction W, a depth direction D, and in a vertical direction V which is perpendicular to the width and depth directions. The vertical direction V may be perpendicular to the horizontal plane HP when the floor elements are connected.

Preferably, the connecting device comprises a single material, such as a polymer-based material or a metal, preferably steel.

The connecting device comprises a first 330 and a second 340 protrusion comprising a first 332 and a second 342 connecting portion, respectively. The first and second protrusions each extend in a direction away from a centre portion CP of the connecting device along the width direction W, cf. FIG. 4*b*. In FIGS. 3*a-b*, the first and second connecting portions are provided in the form of a first 333 and a second 343 bottom surface of the first 330 and the second 340 protrusions, respectively. Each bottom surface 333, 343 may comprise at least a partially planar portion which may be essentially parallel with the lower walls 123 and 223 when the floor elements are connected. More generally, the first connecting portion 332 and/or the second connecting portion 342 may include a respective surface, such as the bottom surface 333, 343, that is essentially parallel to the top side 101, 201 and/or the underside 102, 202 of the floor elements.

The first and the second connecting portions are configured to cooperate—for example, engage—with the first 122 and the second 222 engagement portions, respectively, for vertically connecting the first and second floor elements.

According to preferred embodiments, the connecting device is removably connectable to a support member 500. In some embodiments, and as shown in FIG. 1*a*, a fastening element 400, e.g. in the form of a screw, is provided through a hole 352 (illustrated in FIG. 3*a*) in the connecting device and fastened to the support member. The hole 352 is provided in a bottom portion 350 of the connecting device. Other embodiments of removably connectable connecting devices and associated support members are described further below in relation to FIGS. 10*a-f*, 11*a-f* and 12*a-b* and are equally conceivable instead of a fastening element 400 and a hole 352. In fact, in some embodiments the connecting device may even be permanently fixed to the support member. For simplicity of presentation, the support member 500 and/or a corresponding mechanism for connecting the connecting device to the support member, such as the fastening element 400 or mounting portion 510, will often be suppressed in the embodiments shown in the figures of this disclosure, but their presence may be implicitly understood.

In the embodiment of FIGS. 3*a-b*, the connecting device further comprises a first 310 and a second 320 arm portion extending horizontally towards each other. The first arm portion 310 may comprise an opening 312 which may be at least partly, or optionally completely, aligned with the hole 352 when projected in the horizontal plane HP. Thereby, the hole 352 may be accessed through the opening 312, e.g. by a tool, such as a screw driver. An area of the opening may be larger than an area of the hole.

Preferably, the first and second arm portions at least partially extend along each other in the depth direction D. In some embodiments, the first and second arm portions entirely extend along each other as shown in FIG. 3*a*.

The connecting device is configured to assume a first horizontal state S1 and a second horizontal state S2. A horizontal extension L2, L2' of the connecting device in the second horizontal state S2 is smaller than a horizontal extension L1, L1' of the connecting device in the first horizontal state S1, see FIGS. 3*b* and 3*d*.

The connecting device further comprises a first 360 and a second 370 side portion comprising a first 362 and a second 372 abutment portion, respectively. The protrusions 330 and 340 join and/or extend outwards from the first and the second side portions, respectively. The first and second abutment portions are configured to abut the first 100 and second 200 floor elements, preferably the first lips 130 and 230, respectively, in the first horizontal state S1. The first and second abutment portions extend at least in the vertical direction V and preferably also in the depth direction D. In examples, the first and/or second abutment portion may extend substantially vertically. The first side portion 360 may extend vertically from the bottom portion 350 and may join the second arm portion 320. Moreover, the second side portion 370 may join the first arm portion 310. The second side portion may further comprise an inclined portion 374 extending from the bottom portion 350 and joining the second abutment portion 372. An angle θ between the bottom portion and the inclined portion may be between 15° and 75°, such as between 25° and 65° or between 40° and 50°.

The second side portion 370 may form a displaceable portion 316 which is horizontally displaceable with respect to a body portion 314 of the connecting device, preferably along the width direction W. Thereby, a relative distance between the first 360 and second 370 side portions may be varied, preferably decreased. A portion of the body portion may be fixed with respect to the support member 500 when the connecting device is connected thereto, and may comprise the bottom portion 350 and, optionally, the first side portion 360.

Alternatively, or additionally, the displaceable portion 316 may comprise the first side portion 360 which may be horizontally displaceable with respect to the body portion 314, preferably along the width direction W. In these embodiments, the body portion may comprise the bottom portion 350 and, optionally, the second side portion 360.

Preferably, the first and second protrusions, and hence the first 332 and second 342 connecting portions are horizontally displaceable with respect to each other, such as when the displaceable portion 316 is horizontally displaced.

An extension of the first and/or the second connecting portion from the respective side portion 360, 370 along the width direction W may be smaller than or substantially equal to the space 10, such as a minimal space, between the upper parts of the edge portions 110, 210. Thereby, the removal of a floor element may be facilitated as shown in e.g. in the embodiment in FIGS. 5*a-c*.

In some embodiments, a shape of a first lip surface 132 and a second lip surface 232 of the first lips 130, 230 corresponds to a shape of the first 362 and the second 372 abutment portions, respectively. The first and/or the second lip surface may extend essentially vertically.

As shown in FIGS. 3*a-f*, the connecting device may comprise a locking device 380 for locking the connecting device in the second horizontal state S2. The locking device comprises a first 382 and a second 384 locking element provided on the first 310 and the second 320 arm portion, respectively, preferably at a respective end portion thereof. The locking elements are configured to cooperate with each other, such as by a snapping engagement, and they may be provided as hook elements.

Figure 3C:
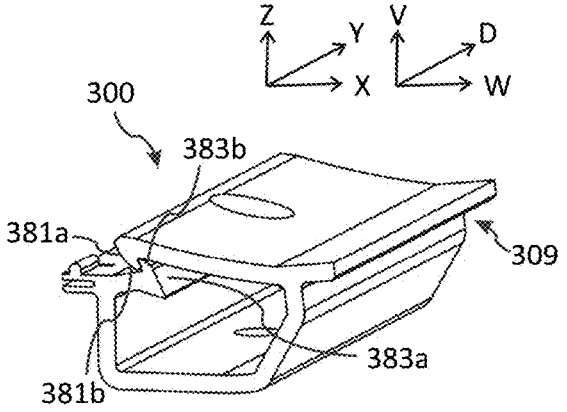
Figure 3D:
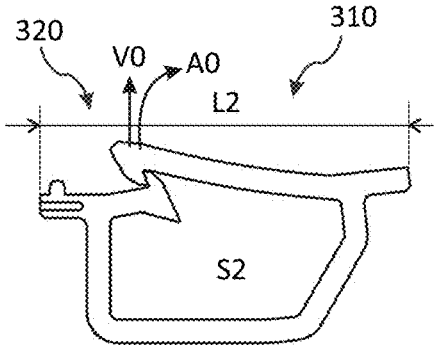
Figure 3E:
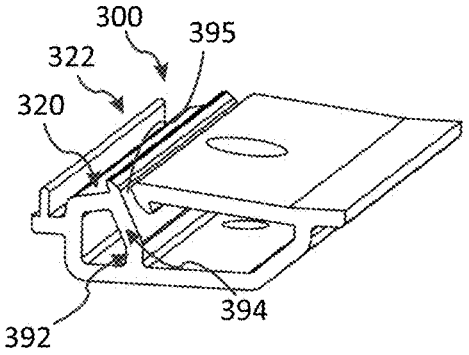

Moreover, the first and second locking elements may comprise a respective sliding surface 381, 383, which preferably are at least partially planar. In some embodiments, each of the sliding surfaces 381, 383 comprises a first planar portion 381*a*, 383*a* and a second planar portion 381*b*, 383*b* as indicated in FIG. 3*c*. The sliding surfaces 381, 383 may be configured to slide against each other when the connecting device transitions from the first S1 to the second S2 horizontal state.

There may be a gap 11 between the first 310 and the second 320 arm portion in the first horizontal state S1. In some embodiments, however, there may be contact between said arm portions in the first horizontal state S1.

Optionally, and as shown in FIGS. 1*a-b*, 2*a-d*, 3*e-f* the connecting device may comprise a wall element 390 whose characteristics will be described further below.

The connecting device may comprise a contact portion 391 configured to contact the displaceable portion 316. In non-limiting examples, the displaceable portion 316 may comprise the first arm portion 310 and the contact portion 391 may comprise at least one selected from the group of the second arm portion 320, the wall element 390 and the sliding surface 381, 383.

The locking device 380 may be unlocked in the first horizontal state S1, see e.g. FIGS. 1*a-c*, 2*a*, 2*c*, 3*a-b*, 3*e-f* and 4*a-h*. Furthermore, the locking device may be locked in the second horizontal state S2, see e.g. FIGS. 2*b*, 2*d* and 3*c-d*.

Figure 8A:
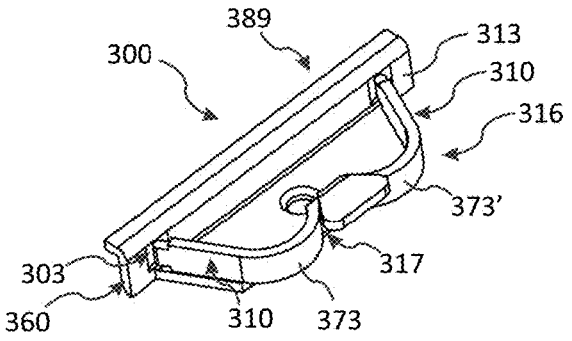
FIGS. 8*a-f* illustrate an embodiment of a connecting device in perspective views, a zoomed-in perspective view, side views, and a top view.
Figure 8B:
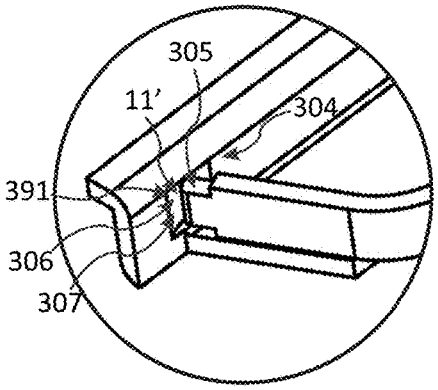
Figure 8C:
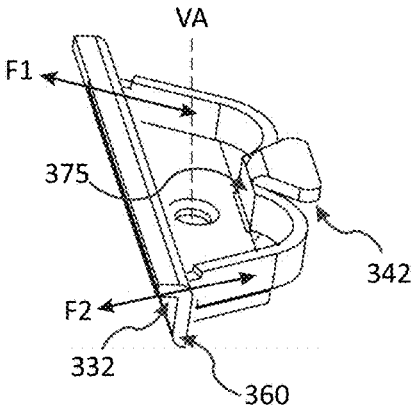
Figure 8D:
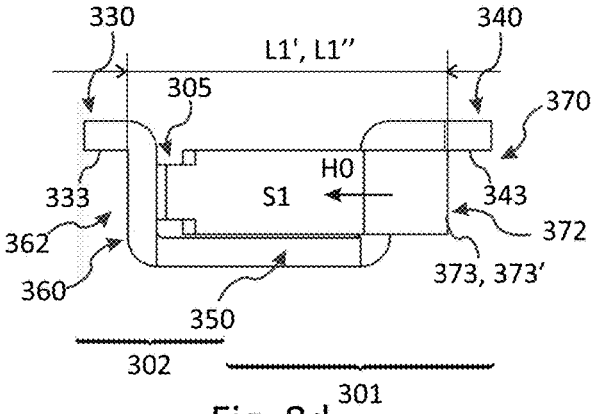
Figure 8E:
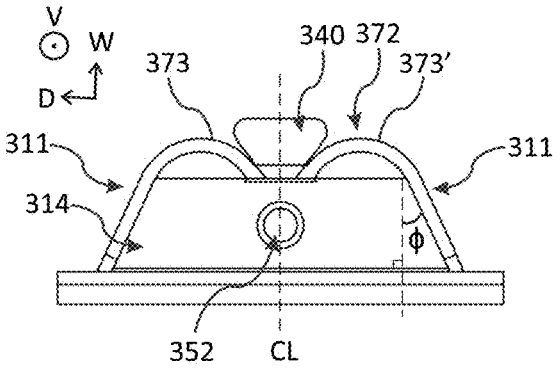
Figure 8F:
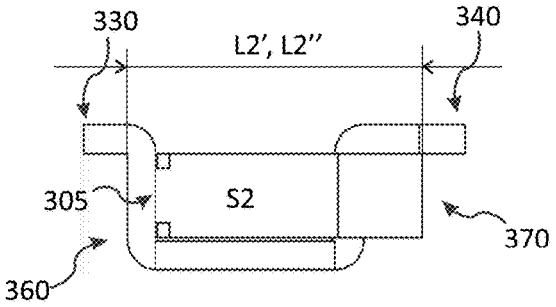

As illustrated in FIGS. 2*a-d* and 3*a-d*, and also in FIGS. 8*a-f* and 11*a-f*, a horizontal extension L2, L2' of the connecting device in the second horizontal state S2 is smaller than a horizontal extension L1, L1' of the connecting device in the first horizontal state S1. In some embodiments, and as shown in FIGS. 2*c-d*, 3*b*, 3*d* and 11*f*, the horizontal extension in the first S1 and second S2 horizontal states is a horizontal extension, preferably a maximal horizontal extension, L1, L2 of the connecting device, such as at a top portion 318 thereof. In some embodiments, and as shown in FIGS. 2*a-d* and 8*a-f*, the horizontal extension in the first S1 and second S2 horizontal states is a horizontal extension, preferably a maximal horizontal extension, L1', L2' between the first 362 and the second 372 abutment portion. In some embodiments, and as shown in FIGS. 2*c-d*, 8*d*, 8*f* and 11*c*, the horizontal extension in the first S1 and second S2 horizontal states is a horizontal extension L1", L2" between the displaceable portion 316, such as an outermost surface thereof along the width direction W, and a fixed surface of the connecting device, such as the first 330 or the second 340 protrusion, such as an outermost surface thereof along the width direction W. In FIGS. 8*d* and 8*f* the fixed surface may be provided in the first abutment portion 362. In any embodiment of the present disclosure, especially in FIGS. 8*a-f* and 11*a-f*, the fixed surface may be provided in the contact portion.

Figure 2A:
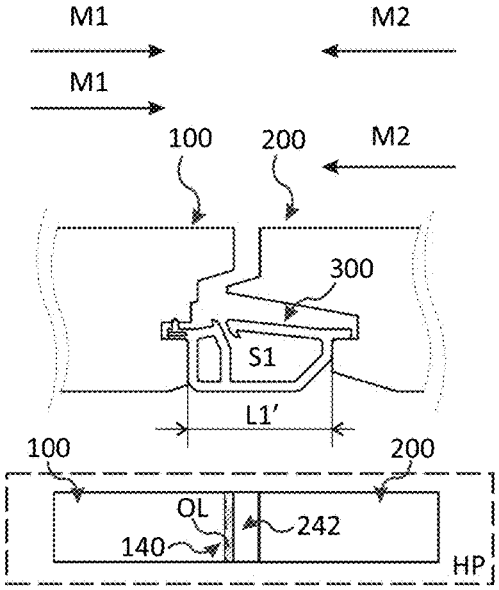
FIGS. 2*a-e* illustrate in side views, a top view, and a perspective view embodiments of flooring systems, connecting devices, and methods of disconnecting floor elements.
Figure 2B:
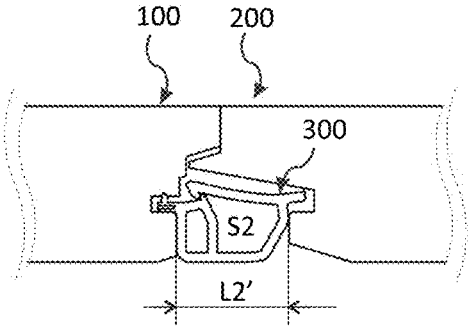
Figure 2C:
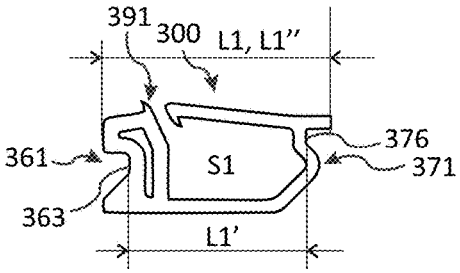
Figure 2D:
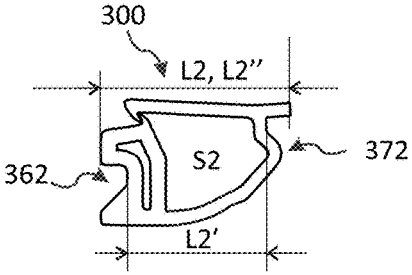
Figure 2E:
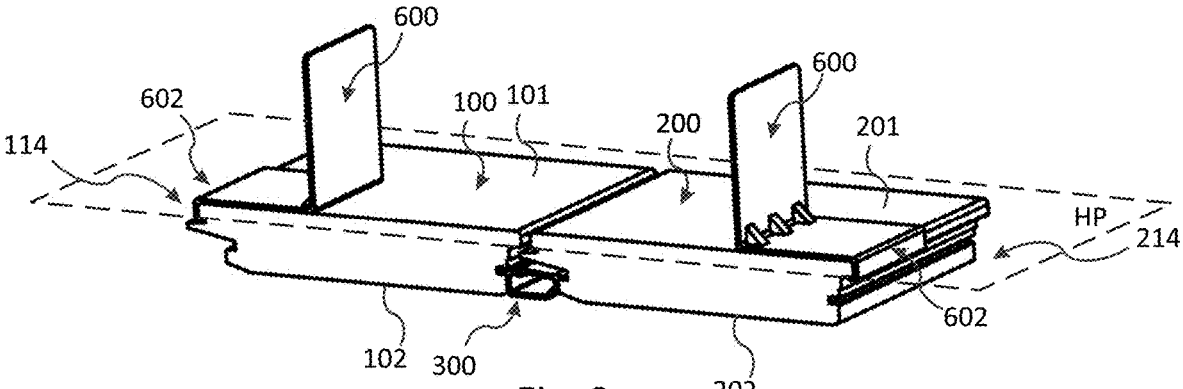

The connecting device may be configured to transition from the first S1 to the second S2 horizontal state by horizontally compressing the connecting device along the width direction W, such as by horizontally displacing the first 100 and second 200 floor elements relatively towards each other along the transverse direction X as illustrated in the embodiments in FIG. 2*a* and FIG. 2*e*. In FIG. 2*e*, a respective gripping portion 602, such as a hooked gripping portion, of a first and a second displacement tool 600 is provided in contact with the opposite edge portions 114 and 214, respectively, preferably with upper parts thereof, such as around the second lips 240 and 140. In some embodiments (not shown), other displacement tools 600 may be utilized. For example, a lever device, such as at least one crowbar, may be provided between a space 10 between the opposite edge portions 114 and 214 of the first and second floor elements, respectively, and a respective adjacent floor element, and the first 100 and second 200 floor elements may be horizontally displaced relatively towards each other by levering or bending the lever device against the respective adjacent floor element.

It is understood that in some embodiments there may be at least one floor element, such as one, two or three floor elements, between the first and second displacement tools 600. Thereby, a pair of transversely outermost floor elements in a set of at least three floor elements may be displaced relatively towards each other for accomplishing a transition from the first S1 to the second S2 horizontal state of a connecting device provided between a pair of floor elements in the set of at least three floor elements.

Alternatively, or additionally, the first and second floor elements or a pair of transversely outermost floor elements in a set of at least three floor elements may be displaced relatively towards each other by other displacement tools 600, such as an arrangement of straps, ratchet straps, clamps, or similarly, around a portion of the floor elements, or around them, and then tightening the arrangement.

In a first example, and as indicated by the arrow M1 in FIG. 2*a*, only the first floor element is displaced. In a second example, and as indicated by the arrow M2, only the second floor element is displaced. In a third example, and as indicated by the arrows M1 and M2, both the first and the second floor elements are displaced. As noted above, in some embodiments the displacement of the adjacent first and second floor elements described in any of the examples above may be replaced by a displacement of a pair of transversely outermost floor elements in a set of at least three floor elements.

Contact between the floor elements, such as upper parts of the floor elements 100, 200, may prevent the connecting device from being further compressed.

The connecting device 300 may transition from the second horizontal state S2 back to the first horizontal state S1. The locking device 380 may be unlocked from the second horizontal state S2 by compressing, preferably horizontally compressing, e.g. along the width direction W, the connecting device and/or by displacing the displaceable portion 316 away from the contact portion 391, e.g. displacing the first arm portion 310 away from the second arm portion 320, such as by a vertical displacement and/or an angling thereof, see the arrows A0, V0 in FIG. 3*d*.

Here, and in any other embodiment of the disclosure, the second horizontal state S2 may be a state such that a ratio R=L2/L1 between the horizontal extension L2, L2', L2" in the second horizontal state and the horizontal extension L1, L1', L1" in the first horizontal state is less than or equal to a critical ratio $R_{crit}$. For example, $R_{crit}$ may be 0.95, preferably 0.9, and more preferably 0.85.

The connecting device may extend only along a portion of the first and second floor elements along their longitudinal direction Y. Preferably, there are a plurality of connecting devices arranged along the longitudinal direction Y for connecting the first and second floor elements. Any embodiment of the connecting device and the first and second floor elements described in the present disclosure is also applicable as embodiments of the plurality of connecting devices.

With reference to e.g. FIG. 3*b*, the connecting device 300 may comprise a first 301 and a second 302 section that are configured to be adjacent to the second 200 and first 100 floor element, respectively, when the first and second floor elements are connected. The first and the second sections may both be flexible, preferably at least horizontally flexible, e.g. along the width direction W. In a first embodiment, the first section 301 is more horizontally flexible, preferably along the width direction W, than the second section 302. In a second embodiment, the second section 302 is more horizontally flexible, preferably along the width direction W, than the second section 301. In any of these embodiments, the displaceable portion, such as the first arm portion, may be displaced more easily than the contact portion, such as the second arm portion, when the connecting device is horizontally compressed.

Preferably, an entire portion extending along the depth direction D of each of the first 301 and second 302 sections are displaceable.

In some embodiments, the connecting device comprises a protruding element 322. In the embodiments shown in FIGS. 3*a-f* and 4*a-f* the protruding element 322 is provided on the second arm portion 320, and preferably extends upwards therefrom. In the connected state, the protruding element may be provided in the first groove 120 as shown in FIGS. 1*a* and 2*a-b*. In some embodiments, the first groove comprises a recess 124 for accommodating at least a portion of the protruding element.

The protruding element 322 may extend along a portion or portions of the connecting device along the depth direction D as illustrated in FIGS. 3*a-d* and 4*e-f*. For example, the protruding element may be provided at end portions of the connecting device along the depth direction D. In some embodiments, the protruding element may extend along the entire connecting device along the depth direction D as illustrated in FIGS. 3*e-f* and 4*a-d*.

Optionally, the second arm portion 320 may comprise a notch element 324 as illustrated in e.g. FIGS. 1*a*, 2*a-b*, 3*a-d* and 4*e-f*. The notch element may extend along the depth direction D at least along a portion of the connecting device, such as alongside of a corresponding protruding element 322. By virtue of the notch element 324, the second arm portion 320, and in particular the protruding element 322, may be vertically compressed and thereby may reduce its vertical extension. This may simplify an insertion of the second arm portion 320 into the first groove 120 and/or an insertion of the protruding element into the recess 124.

As illustrated in e.g. FIGS. 1*a-b*, 2*a-d*, 3*e-f*, 4*a-f*, and 7*a-c*, the connecting device may in some embodiments comprise a wall element 390. The wall element may extend from the bottom portion 350 and may join the first protrusion 330 and/or, when present, the second arm portion 320. The wall element may make portions of the connecting device stiffer.

The wall element 390 may comprise a guiding surface 385 which joins the second locking element 384, such as along the sliding surface 383, as illustrated in e.g. FIGS. 3*e-f*, 4*a-f* and 7*a-b*. The guiding surface 385 may be configured to guide an elongated, preferably flexible, element 620, such as a string or a cord, inserted between the wall element 390 and the second side portion 370 towards the second locking element 384 as may be seen in the embodiment in FIG. 5*b*. Alternatively, or additionally, an inner surface 388 of the first arm portion 310 may be a guiding surface 385' for guiding the elongated element 620.

Figure 3F:
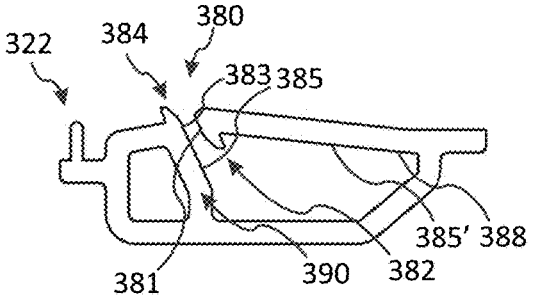

The wall element 390 may comprise a vertical portion 392 extending essentially vertically from the bottom portion 350. Optionally, a portion of, or even the entire, vertical portion 392 may be an inclined portion 394, which preferably comprises a planar surface. A portion of the sliding surface 381 may be an upper surface portion 395 of the vertical portion 392, such as the inclined portion 394. Optionally, a planar portion of the upper surface portion may be essentially parallel with a planar portion of the sliding surface 383 as shown in FIG. 3*f*.

In some embodiments, the connecting device may comprise a friction element 364. The friction element may comprise a flexible and/or compressible material. The friction element may comprise a polymer-based material, such as PVC, and preferably comprising plasticizer, an elastoplastic material, or a rubber, preferably a cross-linked rubber, such as an EPDM rubber. In the embodiment illustrated in FIGS. 4*c-d*, the friction element 364 is provided in a cavity 366 provided in the first side portion 360. Moreover, the friction element may be configured to engage with the first floor element 100, such as the first lip 130, in the first horizontal state S1. For example the friction element may engage with the first lip surface 132. The horizontal extension in the first S1 and second S2 horizontal states may be a horizontal extension, preferably a maximal horizontal extension, L1', L2' between the second abutment portion 372 and the first abutment portion 362 or the friction element 364, such as an outermost portion thereof. Alternatively, the horizontal extension may be a horizontal extension, preferably a maximal horizontal extension, L1, L2 of the connecting device, such as at a top portion 318 thereof.

Figure 4A:
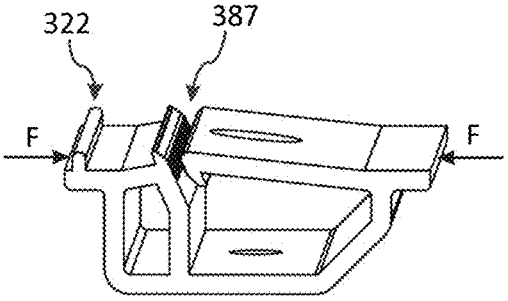
FIGS. 4*a-h* illustrate embodiments of connecting devices in perspective views and side views.
Figure 4B:
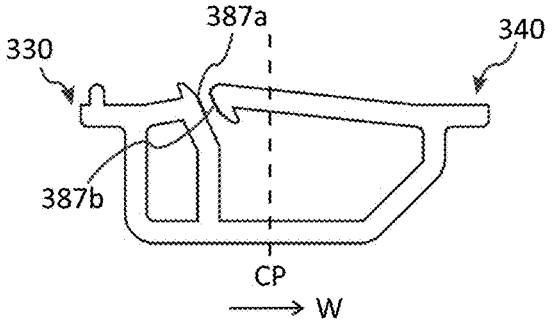
Figure 4C:
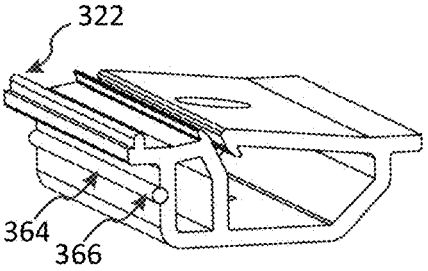
Figure 4D:
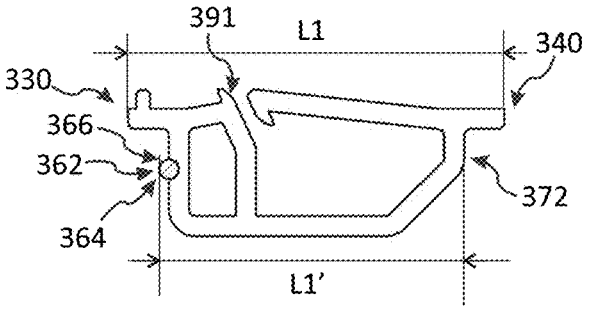
Figure 4E:
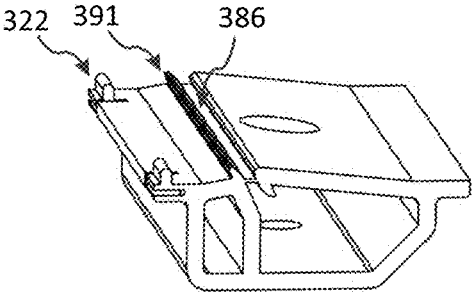
Figure 4F:
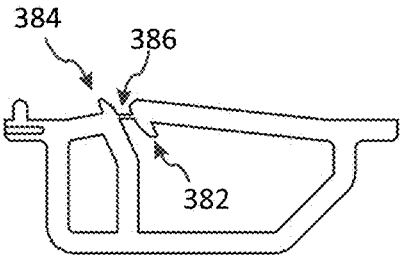

The connecting device may comprise a contact portion 391 configured to contact the displaceable portion 316. The displaceable portion may be connected to the contact portion by a breaking portion 386. FIGS. 4*e-f* show an embodiment illustrating that the first 310 and the second 320 arm portions may be connected to each other by a breaking portion 386. In this particular embodiment, the first 382 and the second 384 locking elements are connected to each other by a breaking portion 386. The breaking portion connects the sliding surfaces 381, 383. The breaking portion may be configured to be broken when the contact portion and the displaceable portion, such as the first and second arm portions, are displaced relative each other, preferably towards each other. In some embodiments, and as shown in FIGS. 4*e-f*, there is a single breaking portion, preferably extending along the entire connecting device along the depth direction D. In some embodiments (not shown), there may be at least two breaking portions provided along the depth direction D and being spaced from each other.

In some embodiments, the displaceable portion 316 and the contact portion 391 may be provided with a resistance element 387. FIG. 4*a* shows an embodiment in which the first and the second locking elements are provided with a resistance element. The first and the second locking elements may comprise ribbed elements 387*a*, 387*b*.

In some embodiments, and as illustrated in FIGS. 1*b* and 2*c-d*, the first side portion 360 may comprise an indentation 361. Thereby, the first abutment portion 362 may comprise a non-planar surface 363. Furthermore, in some embodiments, and as also illustrated in FIGS. 1*b* and 2*c-d*, the second side portion 370 comprises a protuberance 371. Thereby, the second abutment portion 372 may comprise a non-planar surface 376. For example, an extension of any of the non-planar surfaces 363 and 366 along the width direction W may vary along the vertical direction V. Preferably, a cross-section of the non-planar surface is constant along the entire depth extension of the connecting device.

In the first horizontal state S1, the non-planar surface 363 may abut at least one selected from the group of the lower wall 123, an outermost portion of the first lip 130, and the lower wall 133, such as an inclined surface 131. For example, all elements of this group may be selected. Moreover, in the first horizontal state S1, the non-planar surface 376 may abut at least one selected from the group of the lower wall 223, an outermost portion of the first lip 230, the lower wall 233, such as the inclined surface 231, and an inner wall 234 disposed inwardly of the outermost portion. For example, all elements of this group may be selected.

In some embodiments (not shown), the second side portion 370 may comprise an indentation 361 and/or the first side portion 360 may comprise a protuberance 371. The characteristics of the indentation 361 and the protuberance 371 may be the same as for those described in relation to FIGS. 1*b* and 2*c-d*, whereby reference is made to the above.

Other features and functionalities of the embodiments in FIGS. 1*b* and 2*c-d* may be similar to the embodiments described elsewhere in the present disclosure, such as e.g. in FIGS. 1*a*, 1*c*, 2*a-b*, 2*e*, 3*a-f*, 4*a-h*, 7*a-d*, 8*a-f*, 9*a-f* and 10*a-f*.

In some embodiments, and as illustrated in e.g. FIGS. 1*a*, 2*a-b*, 3*a-d*, 4*a-f*, 7*a-d*, 8*a-f*, 9*c* and 10*b*, the first 332 and second 342 connecting portions, e.g. provided in the form of a first 333 and a second 343 bottom surface, respectively, are provided at the same, or substantially the same, height along the vertical direction V in the first horizontal state S1. In some embodiments, and as illustrated in e.g. FIGS. 1*b-c*, 2*c-d*, 3*e-f*, 4*g-h*, but are equally conceivable for the other embodiments, they are provided at different heights.

In a similar manner, in some embodiments, the first 122 and second 222 engagement portions, e.g. provided in the form of a first 123 and a second 223 lower wall, are provided at the same, or substantially the same, height along the vertical direction V. In some embodiments they are provided at different heights. In a first example, the first engagement portion is provided above the second engagement portion. In a second example, the first engagement portion is provided below the second engagement portion.

Figure 4G:
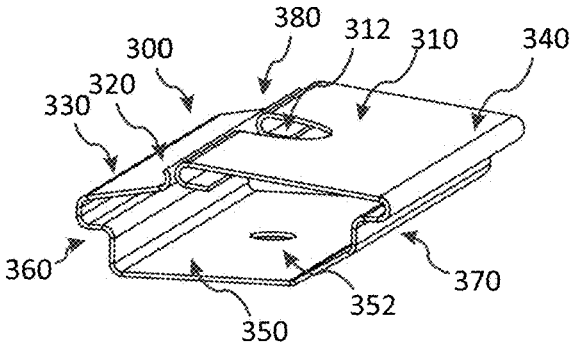
Figure 4H:
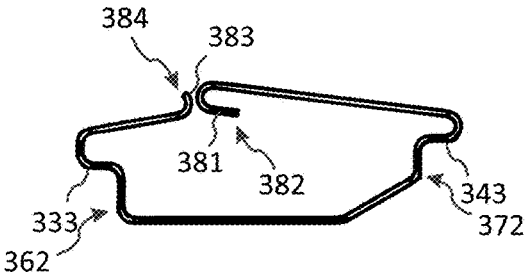

FIGS. 1*c* and 4*g-h* illustrate embodiments in which the connecting device is, or comprises components preferably being made of, metal, such as steel or aluminium. The connecting device may be manufactured by bending a blank of metal. The sliding surface 381 of the second arm portion 320 may be provided as a surface that is curved, preferably upwards. The sliding surface 383 of the first arm portion 310 may be provided as a surface that is curved in the opposite direction of the sliding surface 381, preferably downwards. The sliding surface 381 and/or, as shown in FIG. 4*h*, the sliding surface 383 may comprise a portion that extends essentially in parallel with a segment of the second arm portion 320 and/or a segment of the first 310 arm portion, respectively. The opening 312 may be provided at an edge of the first arm portion 310 as illustrated. The opening 312 may be sidewardly open along the width direction W.

Other features and functionalities of the embodiments in FIGS. 1*c* and 4*g-h* may be similar to the embodiments described elsewhere in the present disclosure, such as in FIGS. 1*a-b*, 2*a-e*, 3*a-f*, 4*a-f*, 7*a-d*, 8*a-f*, 9*a-f*, 10*a-f*, 11*a-f* and 12*a-b*, whereby reference is made thereto.

Figure 5A:
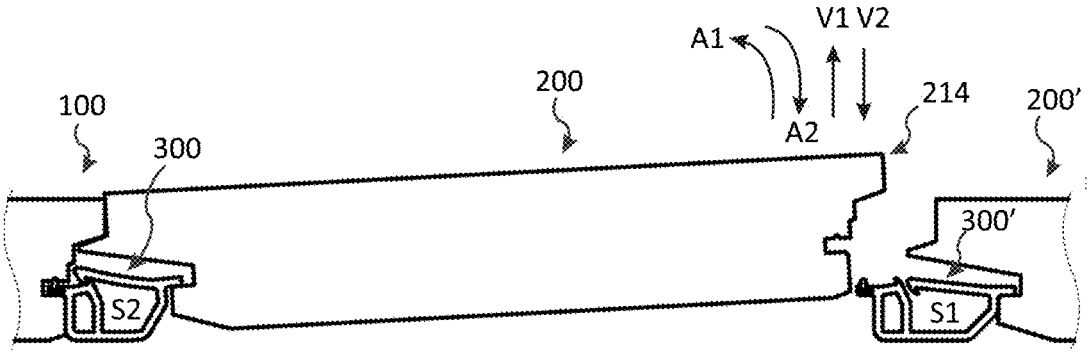
FIGS. 5*a-e* illustrate in side views embodiments of methods of removing and installing floor elements in a flooring system.

FIG. 5*a* illustrates in an embodiment how to remove a floor element 200 from a flooring system comprising three floor elements 100, 200, 200' and two connecting devices 300, 300'. The floor element 200' is adjacent to an opposite edge portion 214 of the second floor element 200. The connecting device 300 connecting the first 100 and second 200 floor elements is caused to transition from the first S1 to the second S2 horizontal state, e.g. by any method described in this disclosure, e.g. in relation to FIGS. 2*a-b* and 2*e*, such as by horizontally displacing the floor elements 100, 200 relatively towards each other. In the present embodiment, the connecting devices 300, 300' each comprise a locking device 380, but this is in no way essential.

Figure 5B:
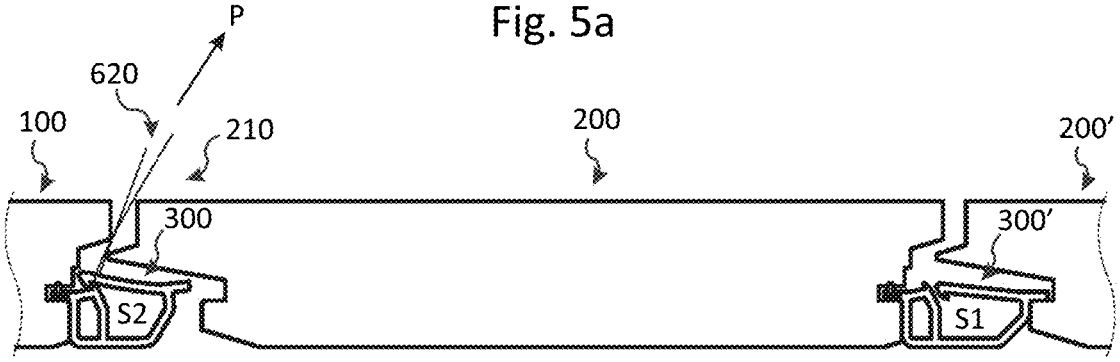

In the second horizontal state S2, a strength of the vertical connection of the floor elements 100, 200 may be reduced compared to a corresponding vertical strength in the first horizontal state S1. For example, the cooperation, such as a contact area, between the second engagement portion 222 and the second connecting portion 342, may be reduced. This may be the case when the second side portion 370 comprises or forms the displaceable portion 316. Alternatively, or additionally, the cooperation, such as a contact area, between the first engagement portion 122 and the first connecting portion 332, may be reduced. This may be the case when the first side portion 360 comprises or forms the displaceable portion 316. In fact, the floor elements 100, 200 may be vertically disconnected as shown in FIG. 5*b*, e.g. in the case the second engagement portion 222 and the second connecting portion 342 disengage, or for example completely disengage, with each other. The second floor element 200 may have to be horizontally displaced away from the first floor element 100 for causing the disengagement. In some embodiments (not shown), the floor elements 100, 200 may be vertically disconnected in a case in which the first engagement portion 122 and the first connecting portion 332 disengage, or for example completely disengage, with each other. The first floor element 100 may have to be horizontally displaced away from the second floor element 200 for causing the disengagement.

Moreover, in the second horizontal state S2 of the connecting device 300, a strength of the vertical connection of the floor elements 200, 200' may be reduced. For example, the cooperation between the first engagement portion 122 of the second floor element 200 and the first connecting portion 332 of the connecting device 300' may be reduced. The floor elements 200, 200' may be vertically disconnected as shown in FIG. 5*a*, e.g. in a case in which the first engagement portion 122 and the first connecting portion 332 of the connecting device 300' disengage, or for example completely disengage, with each other. Alternatively, or additionally, the cooperation between the second engagement portion 222 of the floor element 200' and the second connecting portion 342 of the connecting device 300' may be reduced.

Optionally, or additionally, in the second horizontal state S2, a strength of the vertical connection of the first floor element 100 and a floor element 100' adjacent to an opposite edge portion 114 of the first floor element may be reduced in analogy with the vertical connection of the floor elements 200, 200' whereby reference is made to the above. This is schematically illustrated in FIG. 5*e*, whereby the connecting device 300 is put in the second horizontal state S2 and the first floor element 100 is displaced towards the second floor element 200 for reducing the vertical connection of the floor elements 100, 100'. FIG. 5*d* shows an embodiment of installed floor elements 100, 100', 200, 200' with connecting devices 300, 300', 300" schematically illustrated in first horizontal states S1.

In the second horizontal state S2, the floor element 200 provided between the floor elements 100, 200', such as its opposite edge portion 214, may be displaced vertically upwards V1 and/or angled upwards A1, and thereby may be removed, see FIG. 5*a*. In this configuration, the connecting device 300 may optionally be removed or replaced, e.g. by removing the fastening element 400 from the support member 500 (not shown).

In some embodiments, the edge portion 210 may be displaced vertically upwards and/or angled upwards. This may be suitable when the floor elements 100, 200 are configured as shown in FIG. 5*b*, i.e. when the cooperation between portions 222 and 342 are reduced or completely disengaged as described above. It is understood that in some embodiments, both edge portions 210, 214 may be displaced.

In a non-limiting example, the floor elements 100, 200 and the connecting devices 300, 300' may be configured such that the first 100 and/or the second 200 floor element is removable when the first and second floor elements, such as their upper parts, make contact.

Figure 5C:
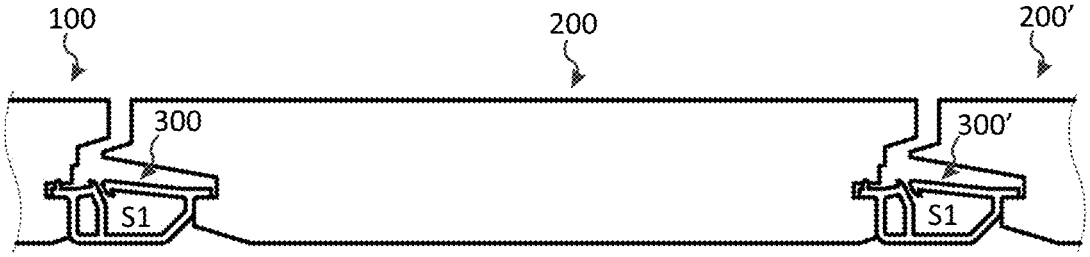
Figure 5D:
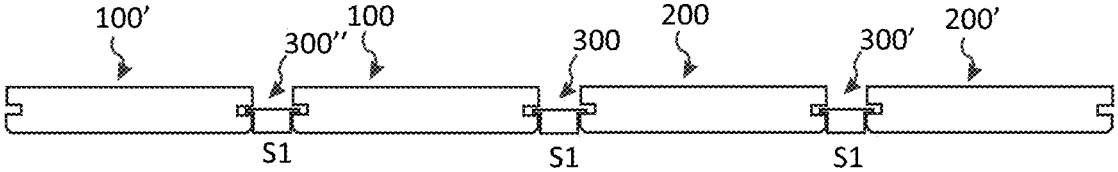
Figure 5E:
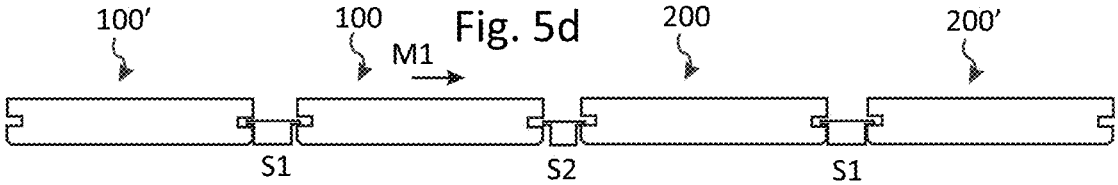

FIGS. 5*a-c* also illustrate in an embodiment how to install a floor element 200 in a flooring system between two floor elements 100, 200' using two connecting devices 300' and 300 assuming the first S1 and the second S2 horizontal state, respectively. The floor element 200 is provided between the floor elements 100, 200', preferably while providing the prominence 242 of the floor element 200 under the second lip 140 of the floor element 100 and/or while letting the second engagement portion 222 of the floor element 200 engage with the second connecting portion 342 of the connecting device 300. The floor element 200, preferably the opposite edge portion 214 thereof, is displaced vertically downwards and/or angled downwards, as indicated by the arrows V2 and A2, respectively, in FIG. 5*a*. When the underside 202 of the floor element 200 is provided on, or is aligned with, the support member 500 (not shown), the floor element 200 may be displaced horizontally towards the floor element 200' so that the first engagement portion 122 of the floor element 200 cooperates with the first connecting portion 332 of the connecting device 300', as shown in FIG. 5*b*.

Next, for connecting the floor elements 100, 200, the connecting device 300 may need to transition from the second horizontal state S2 back to the first horizontal state S1. In this embodiment, the locking device 380 thereby needs to be unlocked as described above in relation of FIG. 3*d*.

In a first example, and as shown in FIG. 5*b*, an elongated, preferably flexible, element 620, such as a string or a cord, may be inserted between the displaceable portion 316 and the contact portion 391 or between the first 360 and second 370 side portions or between the wall element 390 and the second side portion 370 in case the connecting device comprises a wall element as in e.g. FIGS. 3*c-f*. The elongated element is preferably inserted in this manner before the floor element 200 is provided on the subfloor, but it is equally conceivable to insert it afterwards. The elongated element 620 may then unlock the locking device 380, e.g. by pulling it upwards. For example, the first arm portion 310 may be displaced away from the second arm portion 320. The method using the elongated element 620 can be particularly advantageous when the floor elements 100, 200 are configured to conceal the connecting device 300 when the floor elements are connected. Indeed, in this case the connecting device may be difficult to operate using a tool 610 from a position above the floor elements. However, it is clear that the method also is conceivable when the connecting device is visible from above and/or is accessible.

It is understood that the connecting devices 300, 300' may be connected to the support member 500 during the removal and/or installation described above.

Figure 6A:
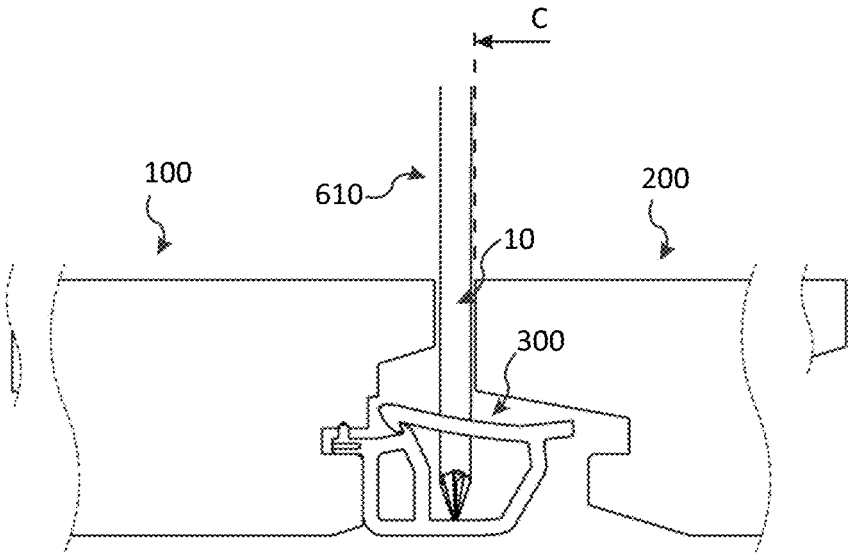
FIGS. 6*a-b* illustrate in a side view and a front view an embodiment of a method of unlocking a connecting device comprising a locking device.
Figure 6B:
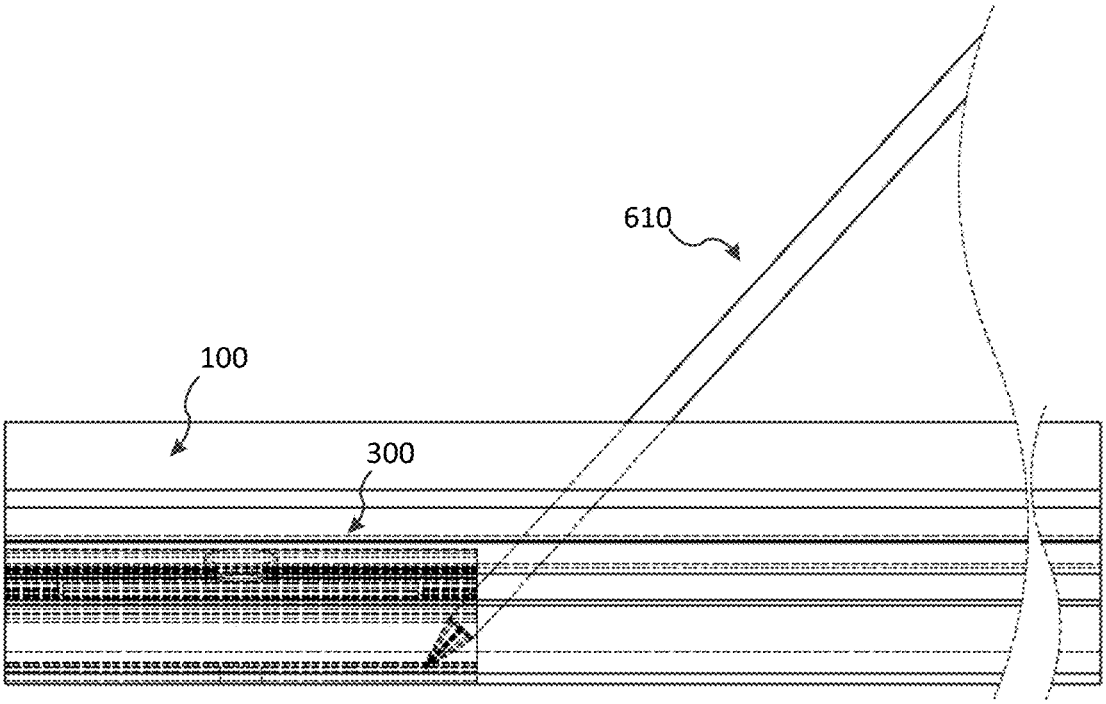

The embodiment in FIGS. 6*a-b* illustrates another method for transitioning back to the first horizontal state S1 which may be utilized when the connecting device is visible from above and/or is operable, preferably with a tool 610, when the floor elements are connected, for example when there is a space 10 between upper parts of the edge portions 110, 210. Indeed, the vertical displacement V0 and/or the angling A0 shown in the embodiment in FIG. 3*d* for unlocking the locking device 380 may be attained by pushing the first arm portion 310 upwards using the tool 610, such as a screw driver or a rod. This is illustrated in the side view in FIG. 6*a* and in FIG. 6*b* which is a front view as seen from the view C in FIG. 6*a*. Alternatively, the locking device 380 may be unlocked manually by a similar operation.

Figure 7A:
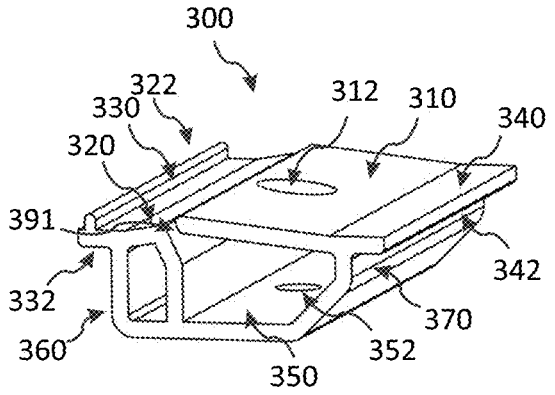
FIGS. 7*a-c* illustrate an embodiment of a connecting device in a perspective view and in a side view; the connecting device is also shown in an installed state.
Figure 7B:
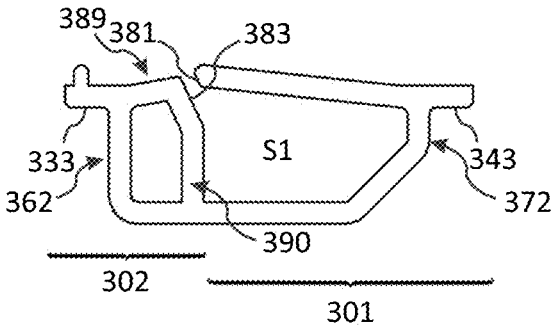
Figure 7C:
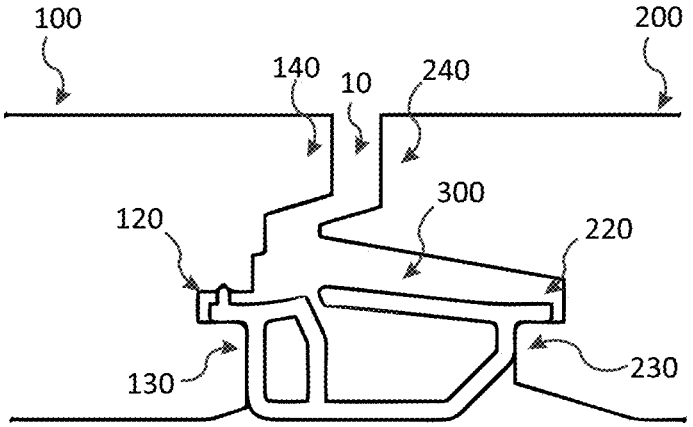

In some embodiments, and as illustrated in FIGS. 7*a-c*, the connecting device 300 does not comprise a locking element 380. In the embodiment in FIGS. 7*a-c*, there are no first 382 and second 384 locking elements provided on the arm portions 320, 310. The end portion of the first 310 and/or second 320 arm portions may comprise a respective sliding surface 381, 383, which preferably is at least partly planar. Thereby, the second arm portion may be guided over the first arm portion when the connecting device is compressed. A wall element 390 may extend from the bottom portion 350 and may join the second arm portion 320.

The embodiment in FIGS. 7*a-c* can be particularly advantageous for use with straps, ratchet straps, clamps, or similarly, e.g. in accordance with the discussion elsewhere in this disclosure. Indeed, an external compression force may be needed for maintaining the connecting device 300 in a second horizontal state S2. When no external compression force is applied, the connecting device may be in, or may transition back to, the first horizontal state S1.

Other features and functionalities of the embodiments in FIGS. 7*a-c* may be similar to the embodiments described elsewhere in the present disclosure, such as in FIGS. 1*a-c*, 2*a-e*, 3*a-f*, 4*a-h* and 5*a-c*.

Figure 7D:
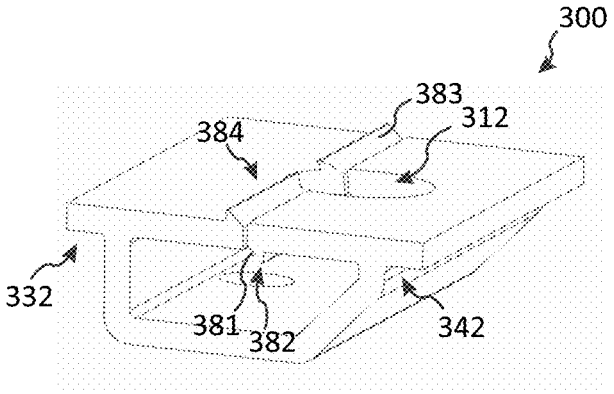
FIG. 7*d* illustrates an embodiment of a connecting device in a perspective view.

In some embodiments, the opening 312 may be provided at an edge of the first 310 and second 320 arm portions. Moreover, the opening 312 at each edge may be sidewardly open along the width direction W. In embodiments in which the connecting device comprises a locking device 380, as illustrated in FIG. 7*d*, the opening 312 may intersect the first 382 and second 384 locking elements. FIG. 7*d* also illustrates that the arm portions 310, 320 may extend substantially in parallel, for example parallel to the plane HP in the connected state. Moreover, FIG. 7*d* illustrates that the sliding surfaces 381 and 383 may extend above, for example entirely above, the second 320 and first 310 arm portions, respectively.

FIGS. 8*a-f* illustrate an embodiment of a connecting device 300 in two perspective views, a zoomed-in perspective view, two side views, and a top view. The connecting device comprises a first side portion 360 extending vertically from the bottom portion 350 and a second side portion 370. A first 330 and a second 340 protrusion comprising a first 332 and a second 342 connecting portion, respectively, join and/or extend outwards from the first and second side portion, respectively.

The second side portion 370 comprises a first arm portion 310 comprising two arms 311, preferably extending at least partially towards the first side portion 360 and preferably being provided symmetrically around a centre line CL extending along the width direction W. As illustrated in FIG. 8*e*, each arm may form an angle $\phi$ with respect to a normal of the first side portion. In examples, the angle may be $10° \leq \phi \leq 60°$, preferably $15° \leq \phi \leq 45°$.

In the present embodiment, the displaceable portion 316 comprises the first arm portion 310 and is horizontally displaceable with respect to a body portion 314 of the connecting device, preferably along the width direction W. Thereby, a relative distance between first 360 and the second 370 side portions may be varied, preferably decreased. A portion of the body portion is fixed with respect to the support member 500 when the connecting device is connected thereto, and may comprise a bottom portion 350 and, optionally, the first side portion 360.

Preferably, the first and second protrusions, and hence the first 332 and second 342 connecting portions, are horizontally fixed, in particular immobile, with respect to each other, such as when the displaceable portion 316 is horizontally displaced.

The displaceable portion 316 may be spaced from the second protrusion 340, such as in the depth direction D. The arms 311 may be connected to the body portion 314, preferably via an intermediate portion 375, e.g. provided in the second side portion 370 as shown in FIG. 8*c*, which may extend upwardly.

The displaceable portion 316 may be displaceable towards and away from the first side portion 360 as indicated by the arrows F1, F2.

In a first example, the connecting device comprises a single material, such as a polymer-based material or a metal, preferably steel. In a second example, the displaceable portion comprises a first material, such as a metal, preferably steel, and a body portion of the connecting device comprises a second material, such as a polymer-based material, e.g. PA, PP, PE, PVC, PS, PU, PC, ABS or TPE. In the second example, the displaceable portion may be formed separately from the body portion and may be attached thereto by an attaching element 317, e.g. by a snapping element or by a tongue and tongue slot configuration.

As shown in FIGS. 8*d* and 8*f*, the connecting device 300 may transition from the first S1 to the second S2 horizontal state by compressing the connecting device, preferably along the width direction W. The compression may be accomplished by displacing the displaceable portion 316 towards the first side portion 360, see the arrow H0 in FIG. 8*d*. Embodiments of the horizontal extensions L1', L1" and L2', L2" have been described elsewhere in the disclosure, whereby reference is made thereto.

The connecting device comprises a first 362 and a second 372 abutment portion extending at least in a vertical direction V. The second abutment portion may comprise at least one curved abutment surface, such as two curved abutment surfaces 373, 373'. Each abutment surface is preferably curved around a vertical axis VA which extends along the vertical direction V.

The connecting device may comprise a barrier member 303 which is configured to prevent the displaceable portion 316, such as the arm portion 310, from being displaced beyond an obstruction element 304, which in the present embodiment may be provided as a segment, or segments, of a first wall portion 313 of the first side portion 360, which preferably is an inner portion thereof. The obstruction element 304 may be a contact portion 391. Moreover, the barrier member may comprise a first barrier element 305 provided in the displaceable portion, such as the arm portion 310, preferably in an end portion thereof, and a second barrier element 306 provided in a first wall portion 313 of the first side portion 360. The first barrier element may be provided on each arm 311 and a corresponding second barrier element may be provided in the first wall portion. The first and second barrier elements are configured to cooperate with each other, preferably by engagement.

The end portion of the first arm portion 310 may be straight as shown in FIGS. 8*a-f*. It is understood, however, and as shown in e.g. FIGS. 9*a-b*, that in some embodiments the end portion may be curved, such as around the vertical axis VA, preferably outwards.

Figure 9A:
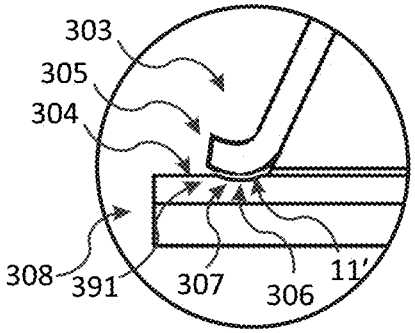
FIGS. 9*a-b* illustrate top views of embodiments of a connecting device zoomed in around an end portion of a displacement portion.

In the embodiment in FIGS. 8*a-f*, and as further illustrated in a top view in an embodiment in FIG. 9*a*, the second barrier element 306 may comprise a pocket 307 configured to receive at least a portion of the first barrier element 305. The pocket may be curved around the vertical axis VA.

Figure 9B:
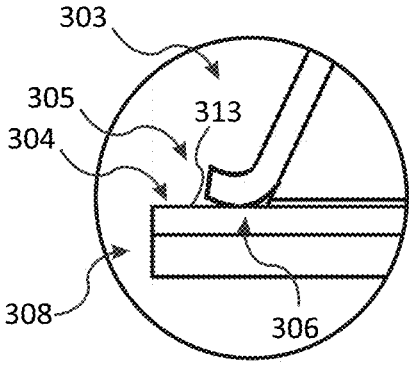

In some embodiments, however, and as illustrated in a top view in FIG. 9*b*, the second barrier element 306 may be provided as a segment or segments in the first wall portion 313. Each segment may be a planar surface.

A vertical extension of the end portion of the displaceable portion 316 may be smaller or substantially the same as a vertical extension of the second barrier element 306. In some examples, and as shown in e.g. FIGS. 8*b* and 8*d*, the end portion of the first arm portion 310 may have a smaller vertical extension than an inner portion of the first arm portion.

In some embodiments, and as shown in FIG. 9*a*, but is also conceivable for the embodiment in FIG. 9*b*, there may be a gap 11' between the first wall portion 313 and the displacement portion 316 in the first horizontal state S1. In some embodiments, and as shown in FIG. 9*b*, but is also conceivable for the embodiment in FIG. 9*a*, there may be contact between said first wall portion and the displaceable portion in the first horizontal state S1.

In any of the embodiments in FIGS. 8*a-f* and 9*a-b*, the end portion of the displaceable portion 316 may slide against the first wall portion 313 when the connecting device is compressed. For example, each arm 311 may slide outwards. Each arm 311 may slide out from the corresponding pocket 307 when a compression force exceeding a first threshold value is applied and may thereby slide against the first wall portion 313 provided outside of the pocket along the depth direction D, which may be planar. In some embodiments, when a compression force exceeding a second threshold value is applied, each arm 311 may be displaced beyond the first wall portion 313 along the depth direction D so that the arms 311, such as end portions thereof, may be positioned in a region 308 beyond the obstruction element 304.

Alternatively or additionally to the embodiments described above, the displaceable portion 316 may comprise the first side portion 360 which may be horizontally displaceable with respect to the body portion 314, preferably along the width direction W. In these embodiments, the body portion may comprise the bottom portion 350 and, optionally, a portion of the second side portion 370, such as the intermediate portion 375.

In some embodiments, the connecting device may comprise at least two first protrusions 330 and/or at least two second 340 protrusions. As shown in a perspective view in the embodiment in FIG. 10*f*, at least two second protrusions 340 may be provided on the displaceable portion 316, such as the first arm portion 310, e.g. in a top portion of the arms 311. Each protrusion 330, 340 may be spaced from each other along the depth direction D and may extend in a direction away from a centre portion CP of the connecting device along the width direction W. Other features and functionalities of the protrusions 330, 340 may be similar to those described in other embodiments in this disclosure, whereby reference is made thereto. For example, the protrusions 330, 340 may join and/or extend outwards from the first 360 and the second 370 side portions, respectively.

Figure 9C:
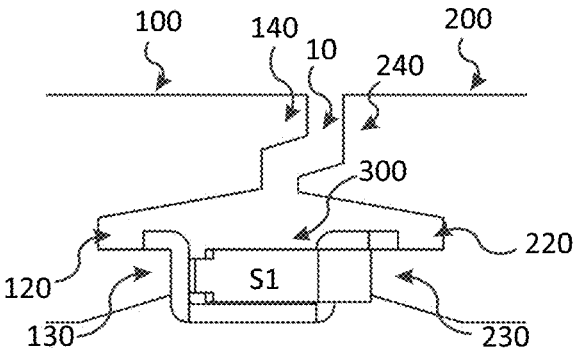
FIG. 9*c* illustrates a side view of an embodiment of floor elements connected by the connecting device according to FIGS. 8*a-f*.

FIG. 9*c* illustrates a side view of a flooring system comprising a first 100 and a second 200 floor element and a connecting system comprising the connecting device 300 in accordance with any of FIGS. 8*a-f* or 9*a-b*. Features of the embodiments of the floor elements in FIGS. 9*c* and/or the connecting device may be similar to any of the embodiments described elsewhere in the present disclosure, such as in FIGS. 1*a-c*, 2*a-e*, 5*a-c*, 6*a-b*, 7*c*, 10*d* and 12*a-b*, whereby reference is made thereto. In particular, and as discussed in relation to FIGS. 7*a-c*, an external compression force may be needed for maintaining the connecting device in a second horizontal state S2.

Figure 10A:
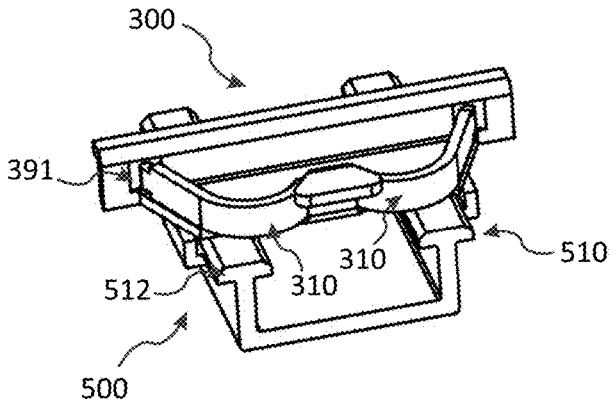
FIGS. 10*a-e* illustrate embodiments of connecting devices and their connection to a support member in a perspective view, two side views, and two front views.
Figure 10B:
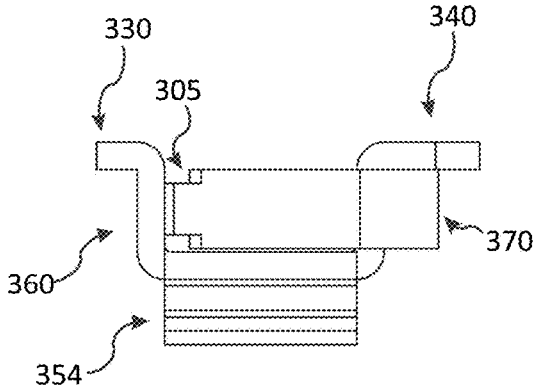
Figure 10C:
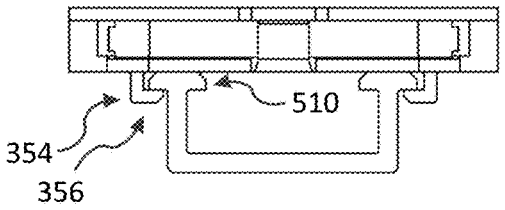
Figure 10D:
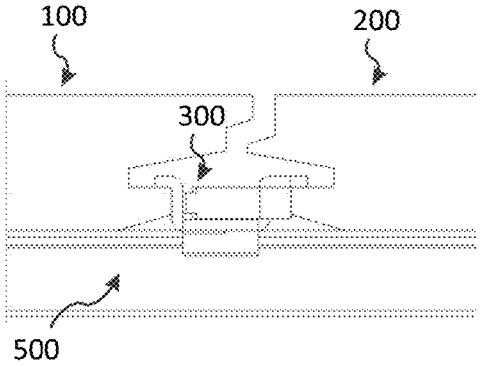

FIGS. 10*a-c* show in a perspective view, a side view, and a front view an embodiment of a connecting device 300 which is removably connectable to a support member 500, such as a joist. The connecting device comprises a coupling portion 354 configured to cooperate with a mounting portion 510 of the support member, preferably by a snapping engagement. The mounting portion may be more rigid than the coupling portion. FIG. 10*d* is a side view of a flooring system in which a first 100 and a second 200 floor element is connected to each other by a connecting device 300 in accordance with the embodiment in FIGS. 10*a-c*.

Figure 10E:
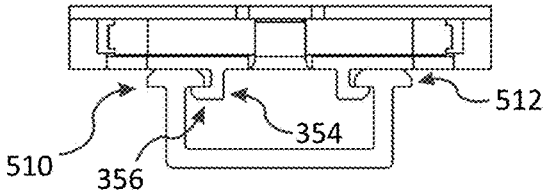

In FIGS. 10*a-d* the coupling portion 354 comprises at least one, such as a two, coupling elements 356 extending inwardly towards each other. Moreover, the mounting portion comprises a wing portion 512. The wing portion may be provided on a vertically extending flank portion and may extend at least outwards from the flank portion. Thereby, the coupling portion 354 may be provided on an outside of the mounting portion 510 when connected thereto. In some embodiments, and as illustrated in FIG. 10*e*, the coupling portion 354 may comprise at least one, such as two, coupling elements 356 extending outwardly away from each other. Moreover, the wing portion 512 may extend at least inwards from the flank portion. Thereby, the coupling portion 354 may be provided on an inside of the mounting portion 510 when connected thereto.

Other features and functionalities of the embodiments in FIGS. 10*a-e* may be similar to the embodiments described elsewhere in the present disclosure, such as e.g. in FIGS. 8*a-f*, 9*a-c* and 10*f*, whereby reference is made thereto. Moreover, a coupling portion 354 configured to cooperate with a mounting portion 510 according to any embodiment above may replace the bottom portion 350 with the hole 352 in any of the embodiments of the present disclosure, such as those in FIGS. 2*c-d*, 3*a-f*, 4*a-h*, 7*a-b*, 7*d* and 8*a-f*.

Figure 11A:
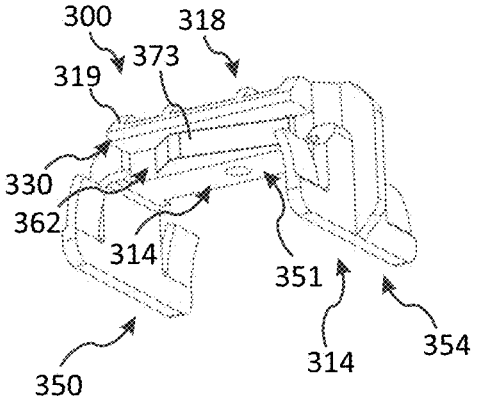
FIGS. 11*a-f* illustrate embodiments of a connecting device in top views, bottom views and perspective views.
Figure 11B:
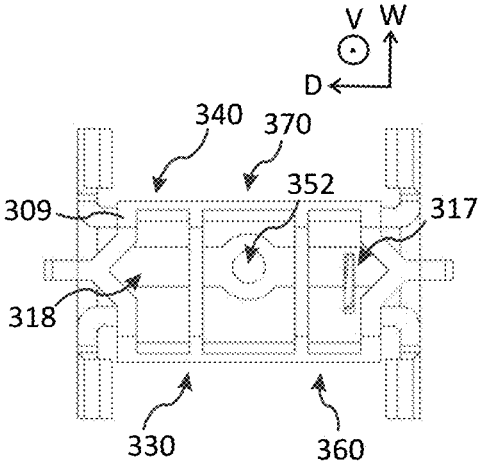
Figure 11C:
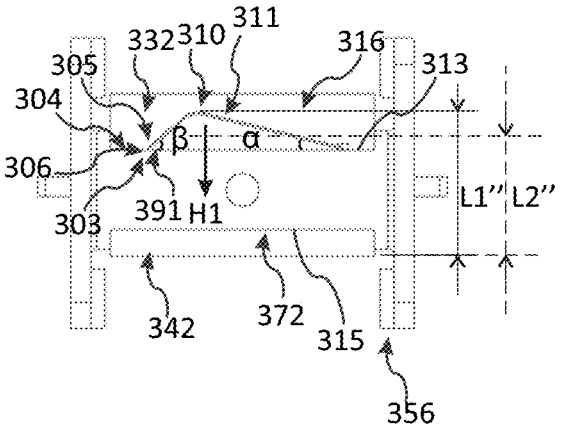
Figure 11D:
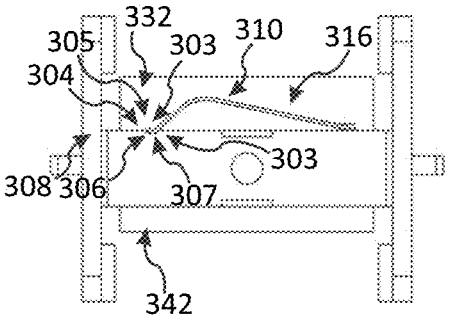
Figure 11E:
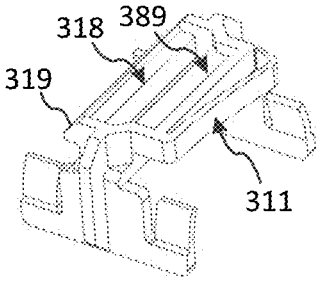
Figure 11F:
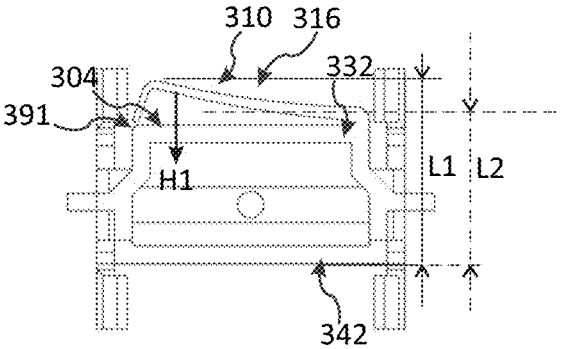
Figure 12A:
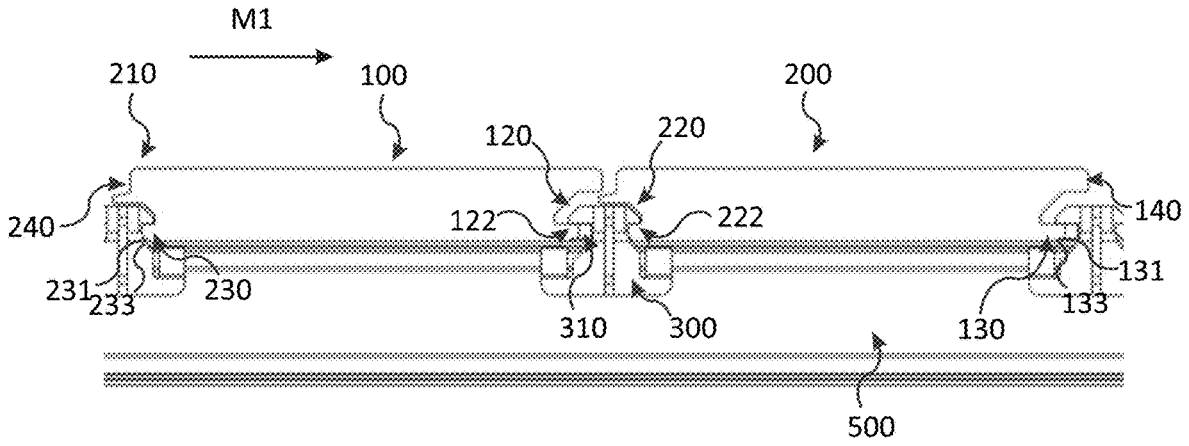
FIGS. 12*a-b* illustrate embodiments of floor elements connected by the connecting device according to any of FIGS. 11*a-f* in a side view and a perspective view.
Figure 12B:
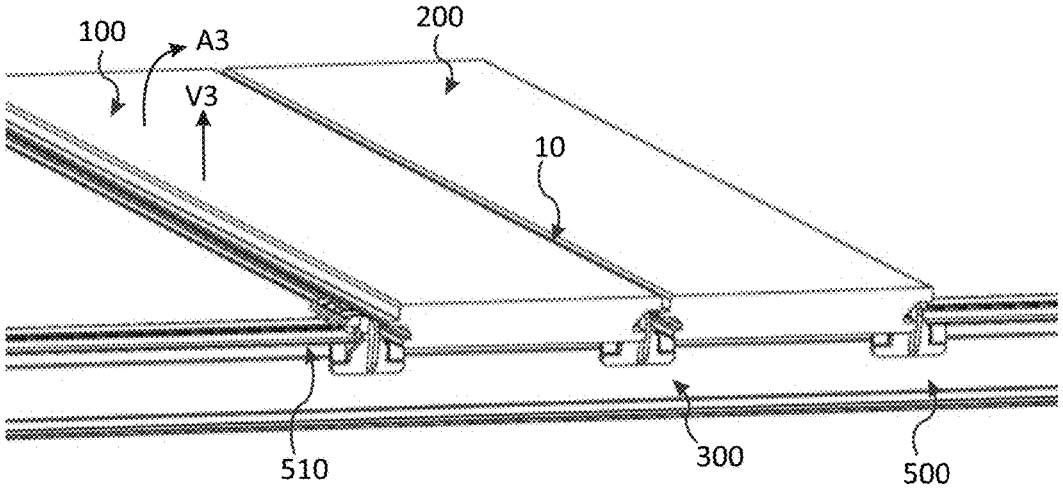

FIGS. 11*a-c* illustrate an embodiment of a connecting device 300 in a perspective view, a top view, and a bottom view. FIG. 11*d* illustrates in a bottom view an embodiment of a connecting device wherein the first arm portion is separately formed from a body portion of the connecting device. Other features and functionalities may be similar to those in FIGS. 11*a-c* and 11*e-f*. FIGS. 11*e-f* illustrate an embodiment of a connecting device 300 in a perspective view and in a top view. The connecting device comprises a first arm portion that is integrally formed with a body portion of the connecting device. Other features and functionalities may be similar to those in FIGS. 11*a-d*. FIGS. 12*a-b* illustrate in a side view and a perspective view embodiments of floor elements 100, 200 connected by the connecting device 300 in any of FIGS. 11*a-f*.

The connecting device comprises a first 360 and a second 370 side portion. A first 330 and a second 340 protrusion comprising a first 332 and a second 342 connecting portion, respectively, join and/or extend outwards from the first and second side portion, respectively.

As illustrated in FIGS. 11*a-f*, the first protrusion 330 and/or the second 340 protrusion may comprise a bevel 309, 319. Optionally, a lower wall 133, 233 of the first lip 130 and/or the first lip 230 may comprise an inclined surface 131, 231 (see, e.g., FIG. 1*b*). An angle of the bevel 309 may correspond to an angle of the inclined surface 231. Moreover, an angle of the bevel 319 may correspond to an angle of the inclined surface 131.

Figure 10F:
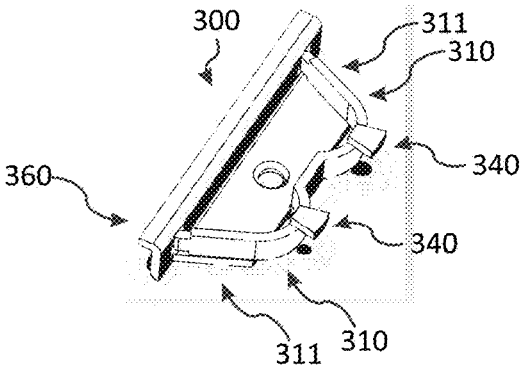
FIG. 10*f* illustrates an embodiment of a connecting device in a perspective view.

In some embodiments, and as described above e.g. in relation to FIG. 10*f*, the connecting device may comprise at least two first protrusions 330 and/or at least two second 340 protrusions. Reference is made to the above for details.

The connecting device comprises an arm portion 310 which may be a first arm portion. The displaceable portion 316 comprises the first arm portion which is horizontally displaceable with respect to a body portion 314 of the connecting device, preferably along the width direction W. Thereby, a relative distance between the first arm portion 310 and the second side portion 370 may be varied, preferably decreased.

The first 330 and second 340 protrusions may be provided in a top portion 318 of the connecting device. Preferably, the first and second protrusions, and hence the first 332 and second 342 connecting portions, are horizontally fixed, in particular immobile, with respect to each other, such as when the displaceable portion is horizontally displaced.

The first arm portion may be provided in the first side portion 360. Alternatively, however, in some embodiments (not shown) an arm portion, such as a second arm portion, may be provided in the second side portion 370. Thereby, the second arm portion of the second side portion may form a displaceable portion. In some embodiments (not shown), a first and a second arm portion may be provided in the first and the second side portions, respectively. Thereby, the first and second arm portions may form a displaceable portion.

The connecting device may comprise an interstitial portion 351 as shown in FIGS. 11*a-c*. The interstitial portion is preferably limited by a first 313 and a second 315 wall portion which may be provided in the first and second side portions, respectively. Preferably, the first and second wall portions are provided below the first 330 and second 340 protrusions, respectively. Moreover, the first and second wall portions are preferably provided inwardly of an outermost surface of the first 330 and second 340 protrusions, respectively.

In the embodiments in FIGS. 11*a-f*, the first arm portion 310 comprises one arm 311, which preferably is curved. The arm may comprise a first portion preferably extending at least partially in a direction away from the first wall portion 313, which preferably comprises a contact portion 391 and/or an obstruction element 304. In embodiments where the first arm portion is separately formed from the first wall portion, the first portion may be attached to the first wall portion by an attaching element 317 such as a snapping element as shown in FIG. 11*b* or a tongue and tongue slot configuration.

The arm may further comprise a second portion preferably extending at least partially in a direction towards the first wall portion 313. The first portion may form an angle, such as a maximal angle, $\alpha$ with respect to an axis extending along the depth direction D. The second portion may form an angle, such as a maximal angle, $\beta$ with respect to said axis. The angle of the second portion may be larger than the angle of the first portion. In examples, the angles may be $5° \leq \alpha \leq 40°$, preferably $15° \leq \alpha 30°$, and $10° \leq \beta \leq 50°$, preferably $20° \leq \beta \leq 40°$.

The body portion 314 may comprise portions that are horizontally fixed, in particular immobile, when the displaceable portion is horizontally displaced. The body portion may comprise the bottom portion 350 and/or the interstitial portion 351, such as the first wall portion 313. The body portion may comprise the first and the second side portions.

At least portions of the displaceable portion 316 may be displaceable towards and away from the first wall portion 313.

The connecting device comprises a first 362 and a second 372 abutment portion extending at least in a vertical direction V. The first abutment portion may be provided on the displaceable portion 316 and may comprise at least one curved abutment surface 373. Each abutment surface is preferably curved around a vertical axis VA which extends along the vertical direction V.

In embodiments (not shown) where an arm portion of the second side portion also forms a displaceable portion as explained above, the second abutment portion may be provided on the displaceable portion and may comprise at least one curved abutment surface.

An extension of the first protrusion 330, in particular the connecting portion 332, along the width direction W from the first wall portion 313 preferably is larger than an extension of the second protrusion 340, in particular the second connecting portion 342, from the second wall portion 315. Thereby, the first arm portion may be accommodated under the first protrusion while allowing for engagement between the first connecting portion and the first engagement portion 122. Moreover, a floor element may be displaced by a smaller distance towards the connecting device for compressing the first arm portion and allowing for a removal of the floor element, such as by angling.

The connecting device may comprise a barrier member 303 which is configured to prevent the displaceable portion, such as the arm portion 310, from being displaced beyond the obstruction element 304, which in the present embodiment may be provided as a segment, or segments, of the first wall portion 313. Moreover, the barrier member may comprise a first barrier element 305 provided in the displaceable portion, such as the arm portion 310, preferably in an end portion thereof, and a second barrier element 306 provided in the first wall portion 313. The first and second barrier elements are configured to cooperate with each other, preferably by engagement.

Embodiments of the barrier member may be the same as those described above in relation to e.g. FIGS. 8*b* and 9*a-b*, whereby reference is made thereto.

The end portion of the first arm portion 310 may be straight as shown in FIGS. 8*a-f*, 11*a-c* and 11*e-f*. It is understood, however, that in some embodiments the end portion may be curved as in FIG. 11*d*.

As shown in FIG. 11*d*, the second barrier element 306 may comprise a pocket 307 configured to receive at least a portion of the first barrier element 305. Embodiments of the pocket are analogous to the embodiments described in relation to FIGS. 8*a-f* and 9*a*, whereby reference is made to the above.

In some embodiments, however, and as illustrated in FIGS. 11*a* and 11*c*, the second barrier element 306 may be provided as a segment or segments in the first wall portion 313. The segment may be a planar surface.

As described in relation to FIGS. 8*a-f* and 9*a-b*, in any of the embodiments in FIGS. 11*a-f* the end portion of the displaceable portion 316 may slide against the first wall portion 313 when the connecting device is compressed. For example, the arm 311 may slide out from the pocket 307 when a compression force exceeding a first threshold value is applied and, in some embodiments, when a compression force exceeding a second threshold value is applied, the arm 311 may be displaced beyond the first wall portion 313.

As illustrated in FIG. 11*c*, the connecting device 300 may transition from the first S1 to the second S2 horizontal state by compressing the connecting device, preferably along the width direction W. The compression may be accomplished by displacing the displaceable portion 316 towards the first wall portion 313, see the arrow H1. A horizontal extension L2, L2', L2" of the connecting device in the second horizontal state S2 is smaller than a horizontal extension L1, L1', L1" of the connecting device in the first horizontal state S1.

Removal and/or installation of a floor element may be similar to the procedure described in relation to FIGS. 5*a-c*, whereby reference is made to the above. In particular, the connecting device may be horizontally compressed by horizontally displacing the floor elements relatively towards each other, such as by horizontally displacing the first floor element 100 relatively towards the second floor element 200, see FIGS. 12*a-b*. When the connecting device is provided in the second horizontal state S2, the floor element 100, such as its edge portion 210, may be displaced vertically upwards V3 and/or angled upwards A3, and may thereby be removed.

In some embodiments, and as shown in FIG. 11*c*, the horizontal extension in the first S1 and second S2 horizontal states is a horizontal extension L1", L2" between the displaceable portion 316, such as the arm portion 310, and a fixed surface of the connecting device, such as the second protrusion 340. The horizontal extension may be a maximal horizontal extension, such as a distance between an outermost surface of the displaceable portion and an outermost surface of the second protrusion along the width direction W. In some embodiments, and as shown in FIG. 11*f*, the horizontal extension L1, L2 in the first S1 and second S2 horizontal states is a maximal horizontal extension of the connecting device, such as at a top portion 318 thereof.

The connecting device may be removably connectable to a support member 500, such as a joist. The connecting device may comprise a coupling portion 354 configured to cooperate with a mounting portion 510 of the support member, preferably by a snapping engagement. For example, the coupling portion 354 and mounting portion 510 may be embodied as in any of FIGS. 10*a-e*.

In some embodiments, and as shown in FIGS. 11*a-f*, the coupling portion 354 may comprise a plurality of coupling elements 356, such as two or four coupling elements, that preferably extend inwardly towards each other. Thereby, the coupling portion 354 may be provided on an outside of the mounting portion 510 when connected. With reference to the discussion above in relation to FIG. 10*e*, it is clear that in some embodiments the coupling portion 354 may comprise a pair of coupling elements 356 extending outwardly away from each other. Thereby, the coupling portion 354 may be provided on an inside of the mounting portion 510 when connected.

A portion of the body portion 314 may be fixed to the support member 500 when the connecting device is connected thereto, and may comprise a bottom portion 350 and/or the interstitial portion 351.

Alternatively, or additionally, and as indicated in FIGS. 11*a-f*, a fastening element 400, e.g. in the form of a screw, may be provided through a hole 352 in the connecting device and fastened to the support member. The hole may be provided in the interstitial portion 351. In some embodiments, the connecting device comprises a hole 352 and does not comprise any coupling elements 356. In such embodiments, a portion provided vertically below the interstitial portion 351 may optionally be removed.

Hence, a connecting device comprising a coupling portion 354 and a support member 500 comprising a mounting portion 510 may be replaced by a connecting device configured to be fastened to a support member by a fastening element 400 as described e.g. in any of FIGS. 1*a-c*, 2*a-e*, 3*a-f*, 4*a-h*, 7*a-d*, 8*a-f*, 9*a-c* and 10*f*.

In a first example, and as illustrated in FIGS. 11*e-f*, the connecting device may be integrally formed and may comprise a single material, such as a polymer-based material. In a second example, and as illustrated in FIGS. 11*a-d*, the displaceable portion may comprise a first material, such as a metal, preferably steel, and the body portion of the connecting device may comprise a second material, such as a polymer-based material, e.g. PA, PP, PE, PVC, PS, PU, PC, ABS, or TPE.

The connecting device, such as in any of the embodiments in FIGS. 10*a-f*, 11*a-f* and 12*a-b*, may be pretensioned against the support member. Thereby, a longitudinal displacement of the connecting device relative the support member may be counteracted. Embodiments of this are described in WO 2018/169483 e.g. on page 22, line 8 to page 24, line 23 and page 61, line 26 to page 62, line 14, which hereby is incorporated by reference. For example, the support element may comprise at least one retention element for holding at least one friction member.

Other features and functionalities of the embodiments in FIGS. 10*a-f*, 11*a-f* and 12*a-b* may be similar to those described in relation to the embodiments in FIGS. 8*a-f* and 9*a-f*, whereby reference is made to those parts of the disclosure.

In non-limiting examples, a width and a depth of the connecting device in any of the embodiments of the present disclosure may be 2 cm≤W≤6 cm, 2 cm≤D≤6 cm and a vertical extension may be 0.5 cm≤V≤4 cm.

Figure 9D:
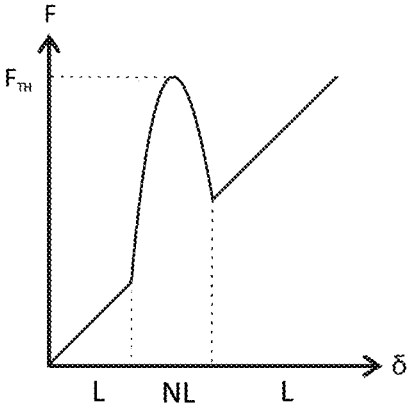
FIGS. 9*d-f* disclose graphs schematically illustrating non-linear behaviors of various embodiments of the connecting device.
Figure 9E:
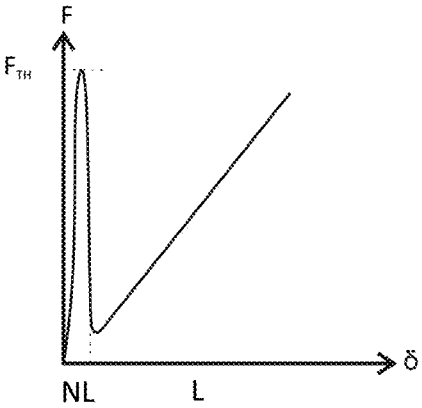
Figure 9F:
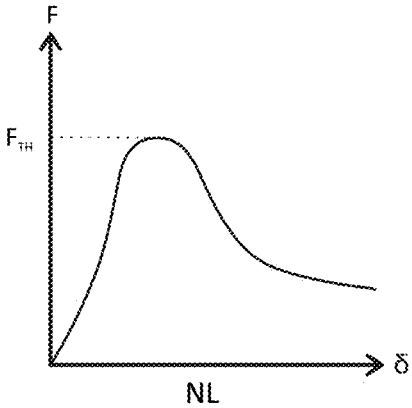

FIGS. 9*d-f* show in graphs a non-linear behavior of the connecting device in accordance with some embodiments thereof. An applied compression force F, such as either or both of those shown in FIG. 4*a*, is plotted as a function of a displacement δ of the connecting device during its compression. The origin in these graphs may correspond to the connecting device being provided in the first horizontal state S1. The graphs are divided into linear regions L, in which the behavior is linear or substantially linear, and non-linear regions NL.

The graph in FIG. 9*d* may correspond to the behavior of a connecting device in accordance with any of the embodiments in e.g. FIGS. 2*c-d*, 3*a-f*, 4*a-d*, 4*g-h*, 7*a-b*, 7*d*, 8*a-f*, 9*a-b*, 10*a-f* and 11*a-f*. A first linear region L near the origin may correspond to a configuration of the connecting device in which there is a gap 11, 11' in the first horizontal state S1 and during an initial compression of the connecting device.

A subsequent non-linear region NL may correspond to a configuration of the connecting device wherein the connecting device transitions from the first S1 to the second S2 horizontal state by being compressed and whereby the displaceable portion 316 makes contact with a contact portion 391 of the connecting device, such as the first arm portion 310 making contact with the second arm portion 320 or with the first wall portion 313. In a first example, sliding surfaces 381, 383 may slide against each other e.g. as in any of the embodiments in FIGS. 2*c-d*, 3*a-f*, 4*a-d*, 4*g-h*, 7*a-b* and 7*d*. In a second example, the end portion of the arm portion 310 and the first wall portion 313 may contact, such as slide against, each other e.g. as in any of the embodiments in FIGS. 8*a-f*, 9*a-b*, 10*a-f* and 11*a-f*.

A subsequent linear region L may correspond to a behavior of the connecting device wherein the displaceable portion 316 and the contact portion 391 do not cooperate anymore during compression or when the displaceable portion has been displaced beyond the obstruction element 304, such as when the first 382 and second 384 locking elements do not cooperate anymore during the compression or when the arm portion 310 has been displaced beyond the obstruction element 304. In a first example, the sliding surface 383 may pass the sliding surface 381 along the width direction W as conceivable in any of the embodiments in e.g. FIGS. 2*c-d*, 3*a-f*, 4*a-d*, 4*g-h*, 7*a-b* and 7*d*. In a second example, the arm portion 310, such as each arm 311, may be displaced beyond the first wall portion 311 along the depth direction D as conceivable in any of the embodiments in FIGS. 8*a-f*, 9*a-b*, 10*a-f* and 11*a-f*. In a first example, the linear spring constants in the first linear region L and the subsequent linear region L are essentially the same. Thereby, an applied compression force may be increased substantially constantly for compressing the connecting device, except in the non-linear region NL. In a second example, the linear spring constants in the first linear region L and the subsequent linear region L are different. By having a larger spring constant in the first linear region L than in the subsequent linear region L a risk of an accidental disconnection of the connecting device may be reduced, while facilitating disconnection once such disconnection has been commenced.

The graph in FIG. 9*e* may correspond to the behavior of a connecting device in accordance with any of the embodiments in e.g. FIGS. 2*c-d*, 3*a-f*, 4*a-h*, 7*a-b*, 7*d*, 8*a-f*, 9*a-b*, 10*a-f* and 11*a-f*. A non-linear region NL near the origin may correspond to a configuration of the connecting device in which there is contact between the displaceable portion 316 and the contact portion 391 of the connecting device. Hence, the non-linear region NL and the subsequent linear region L in FIG. 9*e* may correspond to the non-linear region NL and the subsequent linear region L, respectively, as described in relation to FIG. 9*d* whereby reference is made to the above.

The graph in FIG. 9*f* may correspond to the behavior of a connecting device in accordance with any of the embodiments in e.g. FIGS. 2*c-d*, 3*a-f*, 4*a-h*, 7*a-b*, 7*d*, 8*a-f*, 9*a-b*, 10*a-f* and 11*a-f*. A non-linear region NL may correspond to a configuration of the connecting device in which there is contact between the displaceable portion 316 and the contact portion 391 as described above, such as between the first arm portion 310 and the second arm portion 320 or the first side portion 360, such as the first wall portion, in the first horizontal state S1 as well as during the compression of the connecting device.

$F_{TH}$ indicates a predetermined threshold value of the compression force needed for transitioning from the first to the second horizontal state and is preferably located in a non-linear region NL.

Thus, the connecting device may be provided with a non-linear spring constant along a horizontal direction or, equivalently, a horizontal spring constant. The non-linear spring constant k(δ) may be dependent on a degree of compression of the connecting device along the width direction W.

Hence, the connecting device may be provided with at least a first $k_1$ and a second $k_2$ horizontal spring constant, optionally also a third horizontal spring constant $k_3$. Each horizontal spring constant may be consecutively activated, preferably at different horizontal relative positions of the displaceable portion 316 and the contact portion 391, for example at different horizontal relative positions between the first 310 and second 320 arm portions, such as the locking elements 382, 384, or between the first arm portion 310 and the first wall portion 313. In non-limiting examples, any of the horizontal spring constants $k_1$, $k_2$ and $k_3$ may be a substantially linear or a non-linear horizontal spring constant. In FIG. 9*d*, $k_1$ and $k_3$ are substantially linear and $k_2$ is non-linear. In FIG. 9*e*, $k_1$ is non-linear and $k_2$ is substantially linear. In FIG. 9*f*, $k_1$ is non-linear.

The inventive concept has mainly been described above with reference to a few exemplary embodiments. However, as is readily appreciated by a person skilled in the art, other embodiments than the ones disclosed above are equally possible within the scope of the inventive concept, as defined by the appended patent claims and the items in an "Exemplary Embodiments" section below. For instance, the edge portions of the floor elements may be configured differently; for example, the embodiments of the second lips 140, 240 may be interchanged between the first 100 and second 200 floor elements. Moreover, the contact portion 391 and the displaceable portion 316 may be connected to each other by a breaking portion 386 in any of the embodiments of the disclosure, such as those in FIGS. 7*a-d*, 8*a-f*, 9*a-c*, 10*a-f* and 11*a-f*. Embodiments of the removal and installation of a floor element described in FIGS. 5*a-c* may work similarly for other connecting devices disclosed in this disclosure, such as those without a locking element 380. Finally, it is emphasized that any of the embodiments of the first and second aspects in the summary and of the aspects provided in the "Exemplary Embodiments" section below may be combined with any of the embodiments described in relation to FIGS. 1*a-c*, 2*a-e*, 3*a-f*, 4*a-h*, 5*a-e*, 6*a-b*, 7*a-d*, 8*a-f*, 9*a-f*, 10*a-e*, 11*a-f* and 12*a-b* of the present disclosure.

EXEMPLARY EMBODIMENTS

Further exemplary aspects of the inventive concept are provided below. Exemplary embodiments of these aspects are largely analogous to the exemplary embodiments as described above, whereby reference is made to the above for a detailed description.

Item 1. A flooring system, such as a decking system, comprising floor elements and a connecting system comprising a connecting device (300) for connecting a first floor element (100) and a second floor element (200), wherein the connecting device comprises a first (332) and a second (342) connecting portion, wherein an edge portion (110; 210) of the first and second floor elements comprises a first (122) and a second (222) engagement portion, respectively, the first and the second connecting portions being configured to cooperate with the first and the second engagement portions, respectively, for vertically connecting the first and second floor elements, and wherein the connecting device further comprises a displaceable portion (316) which is horizontally displaceable, preferably along a width direction (W) of the connecting device.

Item 2. The flooring system according to item 1, wherein the displaceable portion (316) is horizontally displaceable with respect to a body portion (314) of the connecting device.

Item 3. The flooring system according to item 1 or 2, wherein a first (360) and/or a second (370) side portion of the connecting device forms the displaceable portion (316), for varying, preferably decreasing, a relative distance between the first and second side portions.

Item 4. The connecting device according to item 2 or 3, wherein a portion of the body portion is configured to be fixed with respect to a support member (500) when the connecting device is connected, preferably removably connected, thereto, and wherein the body portion comprises a bottom portion (350) and, optionally, a first (360) and/or a second (370) side portion of the connecting device.

Item 5. The flooring system according to any of the preceding items 1-4, wherein the connecting device is configured to assume a first (S1) and a second (S2) horizontal state, a horizontal extension (L2; L2'; L2") of the connecting device in said second horizontal state being smaller than a horizontal extension (L1; L1'; L1") of the connecting device in said first horizontal state.

Item 6. The flooring system according to item 5, wherein the connecting device is configured to transition from the first horizontal state to the second horizontal state by horizontally compressing the connecting device and displacing the displaceable portion.

Item 7. The flooring system according to item 6, wherein the connecting device is configured to be horizontally compressed by horizontally displacing the first and second floor elements relatively towards each other.

Item 8. The flooring system according to any of the preceding items, wherein said first and second connecting portions joins and/or extends outwards from a first (360) and a second (370) side portion of the connecting device, respectively.

Item 9. The flooring system according to any of the preceding items, wherein the first (332) and second (342) connecting portions are horizontally fixed, in particular immobile, with respect to each other when the displaceable portion is horizontally displaced.

Item 10. The flooring system according to any of the preceding items 1-8, wherein the first (332) and second (342) connecting portions are displaced horizontally with respect to each other when the displaceable portion is horizontally displaced.

Item 11. The flooring system according to any of the preceding items 5-10, wherein the horizontal extension of the connecting device in each of said first and second horizontal states is:

a maximal horizontal extension (L1; L2) of the connecting device, such as at a top portion (318) thereof, or a horizontal extension (L1'; L2'), such as a maximal horizontal extension, between a first abutment portion (362) and a second abutment portion (372) configured to abut the first and second floor elements, respectively, in the first horizontal state, said first and second abutment portions extending at least in a vertical direction (V), or a horizontal extension (L1"; L2") between the displaceable portion (316), such as an outermost surface thereof along a width direction (W), and a fixed surface of the connecting device, such as a first (330) or a second (340) protrusion, such as an outermost surface thereof along a width direction (W).

Item 12. The flooring system according to any of the preceding items 5-11, wherein a ratio (R) between the horizontal extension (L2; L2'; L2") of the connecting device in said second horizontal state and the horizontal extension (L1; L1'; L1") of the connecting device in said first horizontal state is less than or equal to 0.95, preferably less than or equal to 0.9, and more preferably less than or equal to 0.85.

Item 13. The flooring system according to any of the preceding items, wherein the first and second floor elements are vertically connected in said first horizontal state, and wherein in said second horizontal state:

a strength of a vertical connection of a pair of floor elements in the flooring system is reduced compared to a strength of the vertical connection of said pair of floor elements in the first horizontal state, such as the pair of floor elements being vertically disconnected, and/or at least one floor element in said pair of floor elements is removable in said second horizontal state, such as by angling and/or by a vertical displacement of the respective floor element.

Item 14. The flooring system according to any of the preceding items, wherein the connecting device further comprises a locking device (380) for locking the connecting device in said second horizontal state.

Item 15. The flooring system according item 14, wherein the locking device comprises a first (382) and a second (384) locking element configured to cooperate with each other, such as by a snapping engagement.

Item 16. The flooring system according to item 15, wherein the first and the second locking elements are provided on a first (310) and a second (320) arm portion of the connecting device, respectively, said first and second arm portions preferably extending horizontally towards each other.

Item 17. The flooring system according to any of the preceding items, wherein the displaceable portion is connected to a contact portion (391) of the connecting device by a breaking portion (386), such as a first (382) and a second (384) locking element being connected to each other by a breaking portion (386).

Item 18. The flooring system according to any of the preceding items 14-17, wherein the first and the second locking elements are provided with a resistance element (387).

Item 19. The flooring system according to any of the preceding items 14-18, when depending on any of the items 5-13, wherein the locking device is configured to be unlocked from said second horizontal state by compressing, preferably horizontally compressing, the connecting device and/or by displacing a first arm portion (310) of the connecting device away from a second arm portion (320) of the connecting device, such as by a vertical displacement and/or an angling thereof.

Item 20. The flooring system according to any of the preceding items, wherein the connecting device comprises a guiding surface (385), optionally joining a second locking element (384) of a locking device (380) of the connecting device for locking the connecting device in a second horizontal state (S2).

Item 21. The flooring system according to any of the preceding items, wherein the displaceable portion comprises an arm portion (310), such as a first arm portion.

Item 22. The flooring system according to item 21, wherein the arm portion (310) is a first arm portion (310) and wherein the connecting device further comprises a second arm portion (320), the first and the second arm portions preferably extending horizontally towards each other.

Item 23. The flooring system according to item 21 or 22, wherein the arm portion (310) is provided in a first (360) or a second (370) side portion, preferably comprising a first portion extending at least partially in a direction away from a wall portion (313; 315) of the first (360) or second (370) side portion and optionally further comprising a second portion extending at least partially in a direction towards the wall portion.

Item 24. The flooring system according to any of items 21-23, wherein the arm portion (310) comprises at least two arms (311), preferably extending at least partially towards a first side portion (360) and preferably being provided symmetrically around a centre line (CL) extending along a width direction (W).

Item 25. The flooring system according to any of the preceding items, wherein the connecting device comprises a barrier member (303) configured to prevent the displaceable portion, such as an arm portion (310), from being displaced beyond an obstruction element (304).

Item 26. The flooring system according to item 25, wherein the barrier member comprises a first barrier element (305) and a second barrier element (306) configured to cooperate with the first barrier element, said first barrier element preferably being provided in the displaceable portion and said second barrier element preferably being provided in a first side portion (360) of the connecting device, such as in a wall portion (313) thereof.

Item 27. The flooring system according to item 26, wherein the second barrier element comprises a pocket (307) configured to receive at least a portion of the first barrier element.

Item 28. The flooring system according to any of the preceding items, wherein the first and second connecting portions are provided on a first (330) and a second (340) protrusion of the connecting device, respectively.

Item 29. The flooring system according to item 28, wherein the connecting device comprises a top portion (318) comprising said first (330) and second (340) protrusions.

Item 30. The flooring system according to any of the items 5-29, wherein the connecting device comprises a first abutment portion (362) and/or a second abutment portion (372) configured to abut the first and/or second floor elements in the first horizontal state (S1), said first and second abutment portions extending at least in a vertical direction (V).

Item 31. The flooring system according to item 30, wherein the first (362) and/or the second (372) abutment portion comprises at least one curved abutment surface (373; 373').

Item 32. The flooring system according to item 31 or 32, wherein the first (362) or the second (372) abutment portion is provided on an arm portion, such as a first arm portion (310).

Item 33. The flooring system according to any of the preceding items, wherein a first section (301) of the connecting device is more flexible, preferably horizontally flexible, than a second section (302) of the connecting device, said first section preferably being provided adjacent to the second floor element and said second section preferably being provided adjacent to the first floor element when the first and second floor elements are connected.

Item 34. The flooring system according to any of the preceding items, wherein the first and second engagement portions are provided in a first groove (120) and a second groove (220), respectively, of the first and second floor elements.

Item 35. The flooring system according to item 34, wherein said edge portion (110; 210) of each of the first and second floor elements comprises a first (130; 230) and a second (140; 240) lip provided below and above the first (120) and the second (220) groove of the first and second floor elements, respectively.

Item 36. The flooring system according to item 35, wherein the second lip (140) of the first floor element extends horizontally beyond the first lip (130) of the first floor element, and/or wherein the second lip (240) of the second floor element extends horizontally beyond the first lip (230) of the second floor element.

Item 37. The flooring system according to item 35 or 36, wherein the second lip (240) of the second floor element comprises a prominence (242) extending beyond an uppermost portion (212) of the edge portion (210) of the second floor element.

Item 38. The flooring system according to item 37, wherein the second lip (140) of the first floor element and said prominence (242) at least partially overlap each other in a horizontal plane (HP) being parallel with a top side (101; 201) and/or an underside (102; 202) of each floor element.

Item 39. The flooring system according to any of the preceding items, wherein the first and second floor elements are configured to conceal the connecting device when the floor elements are connected, preferably such that edge portions (110; 210) of the first and second floor elements at least partially overlap each other in a horizontal plane (HP) being parallel with a top side (101; 201) and/or an underside (102; 202) of each floor element.

Item 40. The flooring system according to any of the preceding items 1-38, wherein the connecting device is visible when the first and second floor elements are connected.

Item 41. The flooring system according to any of the items 34-40, wherein the connecting device comprises a protruding element (322) configured to be provided in the first groove (120), the first groove (120) optionally comprising a recess (124) for accommodating at least a portion of said protruding element.

Item 42. The flooring system according to any of the preceding items, wherein the connecting device comprises a friction element (364), preferably provided in a cavity (366) of the connecting device, and being configured to engage with the first floor element (100) in the first horizontal state.

Item 43. The flooring system according to any of the items 5-42, wherein the connecting device is configured to transition from the first horizontal state (S1) to the second horizontal state (S2) when a compression force of the connecting device exceeds a predetermined threshold value $F_{TH}$.

Item 44. The flooring system according to any of the preceding items, wherein the connecting device is provided with a non-linear spring constant along a horizontal direction, said horizontal direction preferably being parallel with a width direction (W) of the connecting device.

Item 45. The flooring system according to any of the preceding items, wherein a spring constant of the connecting device along a horizontal direction (W) is configured to decrease when compressing the connecting device from a first compression level to a second compression level.

Item 46. The flooring system according to any of the preceding items, wherein the connecting device is connectable, preferably removably connectable, to a support member (500), such as by a fastening element (400) provided through a hole (352) in the connecting device.

Item 47. The flooring system according to any of the preceding items, wherein the connecting device comprises a coupling portion (354) configured to cooperate with a mounting portion (510) of a support member (500), preferably by a snapping engagement.

Item 48. The flooring system according to any of the preceding items, wherein, in the first horizontal state (S1), the first connecting portion (332) and/or the second connecting portion (342) extend(s) essentially in parallel with a top side (101; 201) and/or an underside (102; 202) of the floor elements, and, optionally, the first connecting portion (332) and/or the second connecting portion (342) include(s) a respective surface that is essentially parallel to the top side (101; 201) and/or the underside (102; 202) of the floor elements.

Item 49. The flooring system according to any of the preceding items, wherein the first engagement portion (122) and/or the second engagement portion (222) extend(s) essentially in parallel with the top side and/or the underside of the floor elements, the first and second engagement portions optionally being provided in the form of a first (123) and a second (223) lower wall of a first groove (120) and a second groove (220), respectively, of the first and second floor elements.

Item 50. The flooring system according to any of the preceding items, wherein a spring constant of the connecting device along a horizontal direction is configured to decrease when compressing the connecting device from a first compression level to a second compression level.

Item 51. The flooring system according to any of the preceding items, wherein the connecting device is integrally formed.

Item 52. The flooring system according to item 51, wherein the displaceable portion (316) is integrally formed with the connecting device, such as with a body portion (314) of the connecting device.

Item 53. A connecting device (300), independently or according to any of the preceding items 1-52, for connecting a first floor element (100) and a second floor element (200) comprising:

a first (332) and a second (342) connecting portion being configured to cooperate with a first (122) and a second (222) engagement portion of said first and second floor elements, respectively, for vertically connecting the first and second floor elements, and a displaceable portion (316) which is horizontally displaceable with respect to a body portion (314) of the connecting device, preferably along a width direction (W) of the connecting device.

The invention claimed is:

1. A decking system comprising:

floor elements, and a connecting system comprising a connecting device for connecting first and second floor elements of the floor elements, said connecting device being removably connectable, as a whole, to a support member, wherein the connecting device comprises a first and a second connecting portion, wherein an edge portion of the first and second floor elements comprises a first and a second engagement portion, respectively, the first and the second connecting portions being configured to cooperate with the first and the second engagement portions, respectively, for vertically locking the first and second floor elements, and wherein the connecting device further comprises a displaceable portion which is horizontally displaceable, the connecting device being configured to assume a first and a second horizontal state, a total horizontal extension of the connecting device in said second horizontal state being smaller than a total horizontal extension of the connecting device in said first horizontal state, wherein in said first horizontal state:

the first and second floor elements are vertically locked, and the first connecting portion and/or the second connecting portion extend(s) essentially in parallel with a top side and/or an underside of the floor elements, and wherein in said second horizontal state:

a strength of a vertical locking, by the connecting device, of a pair of floor elements in the decking system is reduced compared to a strength of the vertical locking of said pair of floor elements in the first horizontal state.

2. The decking system according to claim 1, wherein the pair of floor elements are vertically unlocked in the second horizontal state and wherein at least one floor element in said pair of floor elements is removable in said second horizontal state.

3. The decking system according to claim 1, wherein the displaceable portion is horizontally displaceable with respect to a body portion of the connecting device.

4. The decking system according to claim 1, wherein a first and/or a second side portion of the connecting device forms the displaceable portion, for varying a relative distance between the first and second side portions.

5. The decking system according to claim 1, wherein the first and second connecting portions are horizontally fixed with respect to each other when the displaceable portion is horizontally displaced.

6. The decking system according to claim 1, wherein the first and second connecting portions are displaced horizontally with respect to each other when the displaceable portion is horizontally displaced.

7. The decking system according to claim 1, wherein the first and second connecting portions are provided on a first and a second protrusion of the connecting device, respectively, and wherein the first and second engagement portions are provided in a first groove and a second groove, respectively, of the first and second floor elements.

8. The decking system according to claim 1, wherein the connecting device is configured to transition from the first horizontal state to the second horizontal state by horizontally compressing the connecting device and displacing the displaceable portion.

9. The decking system according to claim 1, wherein a spring constant of the connecting device along a horizontal direction is configured to decrease when compressing the connecting device from a first compression level to a second compression level.

10. The decking system according to claim 1, wherein the connecting device is integrally formed.

11. The decking system according to claim 1, wherein the displaceable portion is integrally formed with the connecting device.

12. The decking system according to claim 1, wherein the first engagement portion and/or the second engagement portion extend(s) essentially in parallel with a top side and/or an underside of the floor elements.

13. The decking system according to claim 1, wherein the first connecting portion and/or the second connecting portion include(s) a respective surface that is essentially parallel to the top side and/or the underside of the floor elements.

14. The decking system according claim 1, wherein the first and second engagement portions are provided in the form of a first and a second lower wall of a first groove and a second groove, respectively, of the first and second floor elements.

15. A decking system comprising:

floor elements, and a connecting system comprising a connecting device for connecting first and second floor elements of the floor elements, said connecting device being removably connectable to a support member, wherein the connecting device comprises a first and a second connecting portion, wherein an edge portion of the first and second floor elements comprises a first and a second engagement portion, respectively, the first and the second connecting portions being configured to cooperate with the first and the second engagement portions, respectively, for vertically locking the first and second floor elements, and wherein the connecting device further comprises a displaceable portion which is horizontally displaceable, the connecting device being configured to assume a first and a second horizontal state, a horizontal extension of the connecting device in said second horizontal state being smaller than a horizontal extension of the connecting device in said first horizontal state, wherein in said first horizontal state:

the first and second floor elements are vertically locked, and the first connecting portion and/or the second connecting portion extend(s) essentially in parallel with a top side and/or an underside of the floor elements, wherein in said second horizontal state:

a strength of a vertical locking, by the connecting device, of a pair of floor elements in the decking system is reduced compared to a strength of the vertical locking of said pair of floor elements in the first horizontal state, and wherein the connecting device further comprises a locking device for locking the connecting device in said second horizontal state, the locking device comprising a first and a second locking element configured to cooperate with each other.

* * * * *